US012716614B2

(12) United States Patent
Wu et al.

(10) Patent No.: US 12,716,614 B2
(45) Date of Patent: Aug. 25, 2026

(54) WATER TANK ASSEMBLY FOR HEATING DEVICE, AND HEATING DEVICE

(71) Applicant: WUHU MIDEA KITCHEN AND BATH APPLIANCES MFG. CO., LTD., Wuhu (CN)

(72) Inventors: Zitian Wu, Wuhu (CN); Jiqing Ma, Wuhu (CN); Guorong Liang, Wuhu (CN)

(73) Assignee: WUHU MIDEA KITCHEN AND BATH APPLIANCES MFG. CO., LTD., Wuhu (CN)

( * ) Notice: Subject to any disclaimer, the term of this patent is extended or adjusted under 35 U.S.C. 154(b) by 413 days.

(21) Appl. No.: 18/551,875

(22) PCT Filed: Aug. 23, 2022

(86) PCT No.: PCT/CN2022/114353
§ 371 (c)(1),
(2) Date: Sep. 22, 2023

(87) PCT Pub. No.: WO2023/025170
PCT Pub. Date: Mar. 2, 2023

(65) Prior Publication Data

US 2024/0183578 A1 Jun. 6, 2024

(30) Foreign Application Priority Data

Aug. 23, 2021 (CN) ..... 202110969655.X
Aug. 23, 2021 (CN) ..... 202110969674.2

(51) Int. Cl.
*F24H 8/00* (2022.01)
*F24H 1/10* (2022.01)
(Continued)

(52) U.S. Cl.
CPC ..... *F24H 1/107* (2013.01); *F24H 9/0031* (2013.01); *F24H 9/14* (2013.01); *F28F 1/02* (2013.01);
(Continued)

(58) Field of Classification Search
CPC ..... F24H 1/107; F24H 9/0031; F24H 9/00; F24H 9/14; F24H 2210/00; F24H 8/003; F28F 1/02
See application file for complete search history.

(56) References Cited

U.S. PATENT DOCUMENTS 11,243,033 B2 * 2/2022 Iguchi ..... F28D 1/0417

FOREIGN PATENT DOCUMENTS

CN 205048737 U 2/2016
CN 105546822 A 5/2016
(Continued)

OTHER PUBLICATIONS

The Third Office Action received in the counterpart CN application 202110969655.X, mailed on Mar. 11, 2025, 14 pages with English translation.

(Continued)

*Primary Examiner* — Gregory A Wilson
(74) *Attorney, Agent, or Firm* — K&L Gates LLP

(57) ABSTRACT

A tank assembly for a heating device and the heating device are provided. The tank assembly includes: a tank body including a first side plate assembly and a second side plate assembly, a main heat exchange pipe assembly including first heat exchange pipes, a condensation pipe assembly including second heat exchange pipes, and a heat exchange fin assembly. First water boxes are defined by the first side plate assembly, and second water boxes are defined by the second side plate assembly. Every two of the first heat exchange pipes are formed as a reciprocating heat exchange
(Continued)

group. Each reciprocating heat exchange group is in communication with one of the first water boxes and two of the second water boxes to form a series water passageway.

20 Claims, 10 Drawing Sheets

(51) Int. Cl.

| | |
|---|---|
| ***F24H 9/00*** | (2022.01) |
| ***F24H 9/14*** | (2006.01) |
| ***F28F 1/02*** | (2006.01) |
| ***F28F 1/32*** | (2006.01) |

(52) U.S. Cl.
CPC ..... *F28F 1/325* (2013.01); *F24H 8/00* (2013.01); *F28F 2215/10* (2013.01)

(56) References Cited

FOREIGN PATENT DOCUMENTS

| | | | | | |
|---|---|---|---|---|---|
| CN | 105953407 | A | * | 9/2016 | ..... F24H 9/0005 |
| CN | 106016688 | A | * | 10/2016 | ..... F24H 1/107 |
| CN | 206739626 | U | | 12/2017 | |
| CN | 206803498 | U | | 12/2017 | |
| CN | 109114812 | A | | 1/2019 | |
| CN | 209263339 | U | * | 8/2019 | |
| CN | 209341592 | U | | 9/2019 | |
| CN | 209910440 | U | * | 1/2020 | |
| CN | 210165578 | U | | 3/2020 | |
| CN | 210400073 | U | | 4/2020 | |
| CN | 112303913 | A | * | 2/2021 | ..... F24H 9/0036 |
| CN | 212619348 | U | | 2/2021 | |
| CN | 112880194 | A | * | 6/2021 | ..... F24H 8/006 |
| CN | 113137751 | A | | 7/2021 | |
| CN | 113251849 | A | | 8/2021 | |
| EP | 1243866 | A1 | | 9/2002 | |
| JP | 2010007924 | A | | 1/2010 | |
| JP | 2017172903 | A | | 9/2017 | |
| KR | 20190138585 | A | * | 12/2019 | ..... F28D 1/0535 |

OTHER PUBLICATIONS

The Rejection Decision received in the counterpart CN application 202110969655.X, mailed on May 29, 2025, 12 pages with English translation.
The First Office Action received in the counterpart CN application 202110969674.2, mailed on Mar. 28, 2025, 12 pages with English translation.
Written Opinion of the ISA received in PCT/CN2022/114353; mailed Nov. 16, 2022.
First OA received in CN Application No. 202110969655.X; mailed Jun. 15, 2024.
The Grant Notice received in the counterpart CN application 202110969674.2, mailed on Sep. 19, 2025, 5 pages with English translation.
International Search Report received in PCT/CN2022/114353; malled Nov. 16, 2022.

* cited by examiner

WATER TANK ASSEMBLY FOR HEATING DEVICE, AND HEATING DEVICE

CROSS-REFERENCES TO RELATED APPLICATIONS

The present disclosure is a national phase application of International Application No. PCT/CN2022/114353, filed on Aug. 23, 2022, which claims priorities to Chinese Patent Applications No. 202110969655.X and No. 202110969674.2, filed on Aug. 23, 2021, the entireties of which are herein incorporated by reference.

FIELD

The present disclosure relates to the field of heating device technologies, and more particularly, to a water tank assembly of a heating device and a heating device having the same.

BACKGROUND

A heating device using fully premixed technology is increasingly valued by consumers since it has lower smoke emissions and more environmentally friendly. As a core component of the heating device, a water tank assembly is a conversion device for converting cold water into hot water.

In the related art, when the heating device operates, condensed water would be generated in the water tank assembly and can corrode the water tank assembly due to its corrosivity, which may shorten service life of the water tank assembly. An existing water tank assembly has a parallel water passageway, and thus such a design is unreasonable. In some heat exchange pipes, a water flow rate or a water flow velocity is not uniform, which leads to a phenomenon of empty pipes or water siltation in some heat exchange pipes having a relatively small water flow rate and a relatively slow water flow velocity. This easily causes wall surfaces of the heat exchange pipes to have relatively high temperature, water in the heat exchange pipes is vaporized, and a formation of scale in the heat exchange pipes is accelerated. As a result, thermal effect may occur in the heat exchange pipes, which would damage the heat exchange pipes, and will result in water leakage of the heat exchange pipes in severe cases, to shorten service lives of the water tank assembly and the heating device.

In addition, in order to solve the problem of the water vaporization in the heat exchange pipe, in the related art, a disturbance member is provided in the heat exchange pipe to increase disturbance. However, the disturbance member will increase a water flow resistance, and will also bring a risk of scale formation in the heat exchange pipe, which results in blockage of the heat exchange pipe. As a result, a dry burn and a rupture may occur to the heating device.

SUMMARY

The present disclosure aims to solve at least one of problem in the related art. To this end, embodiments of the present disclosure provide a water tank assembly of a heating device. With the water tank assembly of the heating device, a water flow rate or a water flow velocity in a main heat exchange pipe assembly and a condensation pipe assembly is uniform, and water vaporization and scaling in the main heat exchange pipe assembly and the condensation pipe assembly can be alleviated. Therefore, service lives of the water tank assembly and the heating device can be prolonged.

Embodiments of the present disclosure further provide a heating device.

The water tank assembly of the heating device according to embodiments of the present disclosure includes a tank body, a main heat exchange pipe assembly, a condensation pipe assembly, and a heat exchange fin assembly. The tank body has a smoke inlet and a smoke outlet. The tank body includes a first side plate assembly and a second side plate assembly that are opposite to each other. First water boxes are defined by the first side plate assembly, and second water boxes are defined by the second side plate assembly. A water inlet and a water outlet are formed on the first side plate assembly, and each of the water inlet and the water outlet is in communication with one of first water boxes. The main heat exchange pipe assembly includes first heat exchange pipes. The condensation pipe assembly is located on a side of the main heat exchange pipe assembly facing towards the smoke outlet. The condensation pipe assembly includes second heat exchange pipes. First water boxes are in communication with second water boxes via the main heat exchange pipe assembly and the condensation pipe assembly. Every two of first heat exchange pipes are formed as a reciprocating heat exchange group. Each reciprocating heat exchange group is in communication with one of first water boxes and with two of second water boxes to form a series water passageway. At least some of first heat exchange pipes and/or at least some of second heat exchange pipes pass through the heat exchange fin assembly.

With the water tank assembly of the heating device, by communicating each reciprocating heat exchange group with one of first water boxes and two of second water boxes to form a series water passageway, compared with the related art, in the present disclosure, the water flow rate or the water flow velocity in the main heat exchange pipe assembly and the condensation pipe assembly is more uniform. Further, the water vaporization and the scaling in the main heat exchange pipe assembly and the condensation pipe assembly can be alleviated. Therefore, it is possible to prevent a dry burn and a rupture from occurring to the heating device, which in turn can prolong the service lives of the water tank assembly and the heating device.

In some embodiments of the present disclosure, at least some of first heat exchange pipes each have an elliptic cross section.

In some embodiments of the present disclosure, the water tank assembly of the heating device further includes fire-side heat exchange pipes provided at a side of the main heat exchange pipe assembly facing towards the smoke inlet. fire-side heat exchange pipes is in communication with first water boxes and second water boxes, respectively.

In some embodiments of the present disclosure, fire-side heat exchange pipes is provided at an upper side of the main heat exchange pipe assembly. No heat exchange fin is provided for fire-side heat exchange pipes.

In some embodiments of the present disclosure, each of fire-side heat exchange pipes has a circular cross section.

In some embodiments of the present disclosure, no disturbance member is disposed in each of fire-side heat exchange pipes.

In some embodiments of the present disclosure, each of first water boxes in communication with the condensation pipe assembly is in communication with at least three of second heat exchange pipes. Second heat exchange pipes corresponding to each of first water boxes are arranged in rows and columns.

In some embodiments of the present disclosure, first heat exchange pipes are arranged in one layer and passes through the heat exchange fin assembly. The heat exchange fin assembly through which first heat exchange pipes passes are disposed on the condensation pipe assembly.

In some embodiments of the present disclosure, the tank body further includes a first heat insulation plate and a second heat insulation plate opposite to the first heat insulation plate. The first heat insulation plate is engaged with the first side plate assembly and the second side plate assembly, and the second heat insulation plate is engaged with the first side plate assembly and the second side plate assembly. Each of the first heat insulation plate and the second heat insulation plate being an integrated piece.

In some embodiments of the present disclosure, the heat exchange fin assembly includes first fins arranged sequentially in a length direction of each of first heat exchange pipes. Each first fin has a through hole, and the through hole penetrates the first fin in a thickness direction of the first fin. The first fin includes a second sub-fin disposed on an inner wall of the first heat insulation plate on a side wall of the tank body.

In some embodiments of the present disclosure, the tank body further includes a smoke baffle located at a side of the condensation pipe assembly away from the main heat exchange pipe assembly. The smoke outlet is formed on the smoke baffle.

In some embodiments of the present disclosure, the smoke baffle includes guide plates away from the smoke inlet. The smoke outlet has a first channel. Ends of the guide plates away from the smoke inlet are arranged at intervals to define the first channel.

In some embodiments of the present disclosure, the smoke outlet further has a second channel. Second channels is formed on each of the guide plates.

A heating device according to embodiments of the present disclosure includes the water tank assembly as described above.

Additional embodiments of the present disclosure will be provided at least in part in the following description, or will become apparent at least in part from the following description, or can be learned from practicing of the present disclosure.

DETAILED DESCRIPTION OF THE DISCLOSURE

Figure 1:
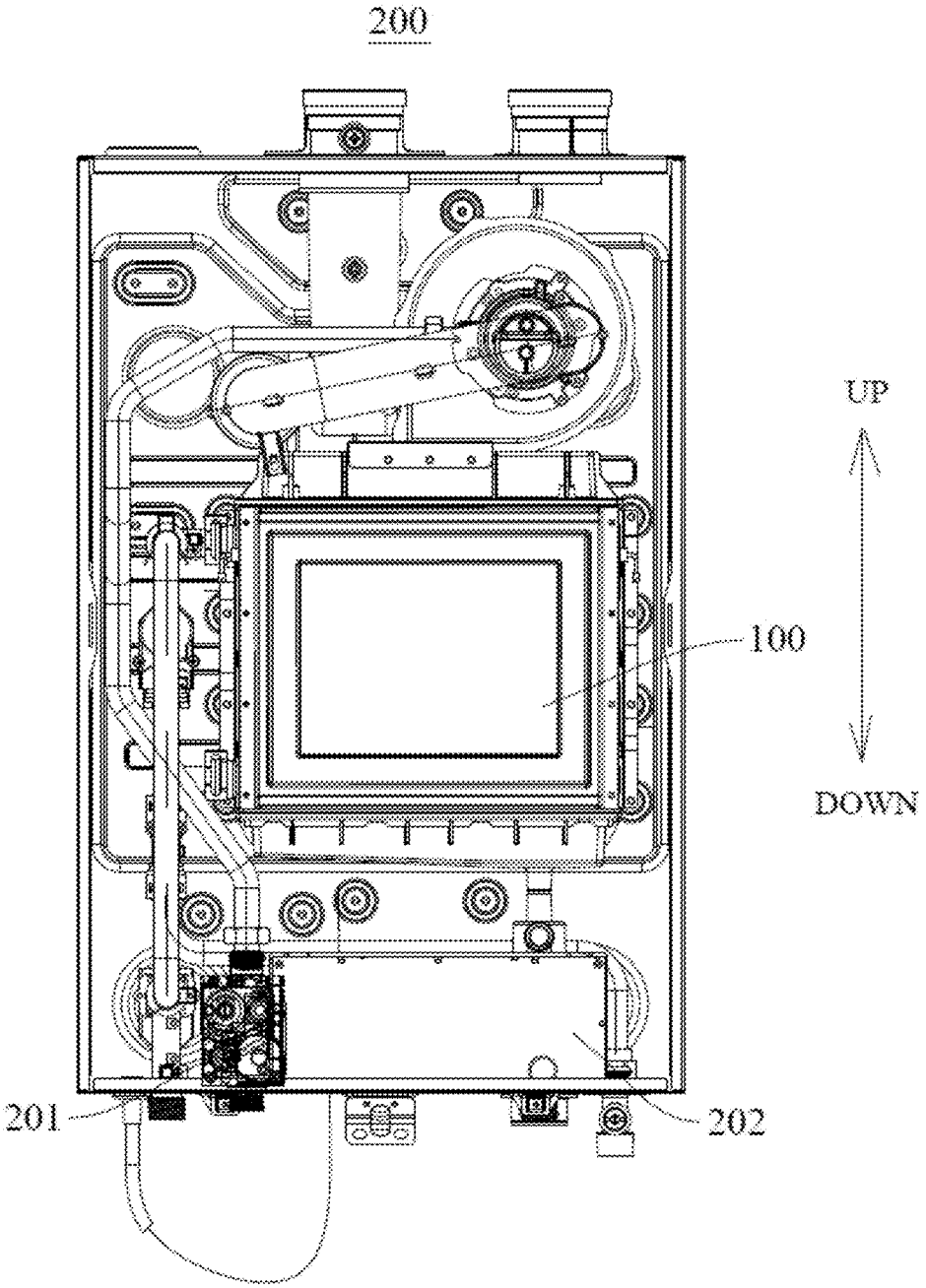
FIG. 1 is a cross-sectional view of a heating device according to an embodiment of the present disclosure.

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain, rather than limiting, the present disclosure.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc., is based on the orientation or position relationship shown in the drawings, and is merely for the convenience of describing the present disclosure and simplifying the description, rather than indicating or implying that the associated apparatus or element must have a specific orientation, or be constructed and operated in a specific orientation, and therefore cannot be understood as a limitation to the present disclosure. In addition, the features associated with "first" and "second" may explicitly or implicitly include one or more of the features. In the description of the present disclosure, "plurality" means at least two, unless otherwise specifically defined.

In the description of the present disclosure, it should be noted that terms such as "installed", "connected", and "coupled" should be understood in a broad sense, unless otherwise clearly specified and limited. For example, it may be a fixed connection or a detachable connection or connection as one piece; mechanical connection or electrical connection; direct connection or indirect connection through an intermediate; or internal communication of two components. The specific meaning of the above-mentioned terms in the present disclosure can be understood according to specific circumstances.

A heating device 200 according to an embodiment of the present disclosure is described below with reference to FIG. 1 to FIG. 15. The heating device 200 includes a water tank assembly 100, and may be provided as a water heater or a wall-mounted oven.

As illustrated in FIG. 1 to FIG. 15, the water tank assembly 100 according to an embodiment of the present disclosure includes a tank body 10, a main heat exchange pipe assembly 20, a heat exchange fin assembly 40, and a condensation pipe assembly 30. The tank body 10 has a smoke outlet 12 and a smoke inlet 11. A burner may be provided for the heating device 200. High temperature smoke generated through combustion in the burner may flow into the tank body 10 from the smoke inlet 11. The high temperature smoke in the tank body 10 may flow out of the tank body 10 from the smoke outlet 12. The tank body 10 includes a first side plate assembly 17. The tank body 10 further includes a second side plate assembly 18. The second side plate assembly 18 and the first side plate assembly 17 are opposite to each other. Further, the second side plate assembly 18 and the first side plate assembly 17 are opposite to each other in a first direction of the water tank assembly 100. The first direction of the water tank assembly 100 may refer to a left-right direction in FIG. 2. Also, the second side plate assembly 18 and the first side plate assembly 17 are spaced apart from each other in the first direction of the water tank assembly 100. First water boxes 131 is defined by the first side plate assembly 17. Second water boxes 141 is defined by the second side plate assembly 18.

Figure 2:
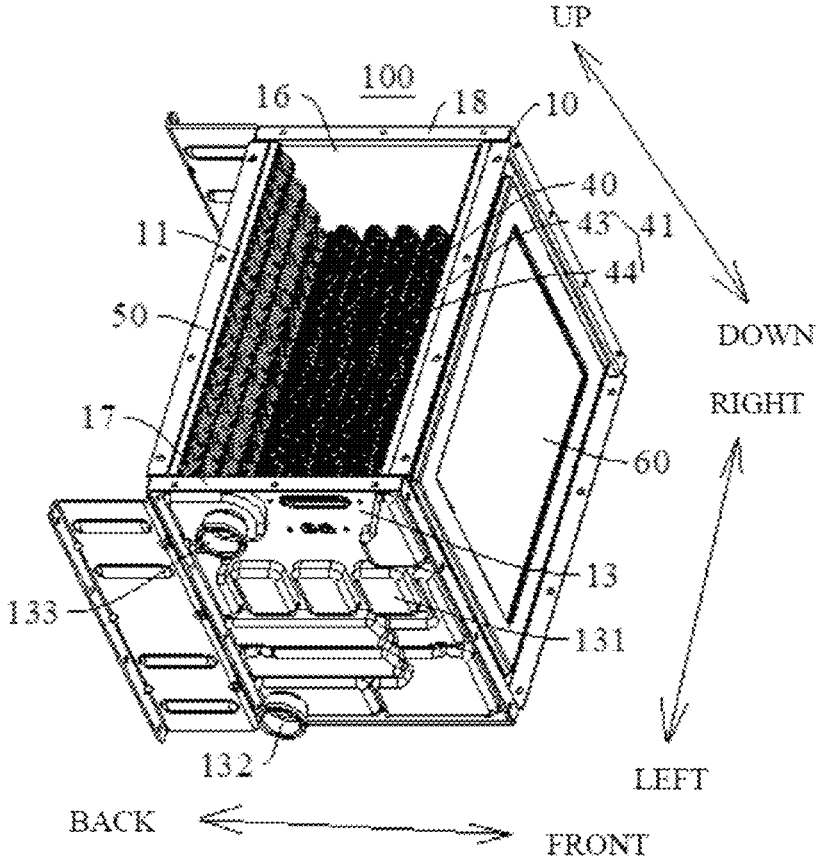
FIG. 2 is a schematic view of a water tank assembly of a heating device according to an embodiment of the present disclosure.
Figure 3:
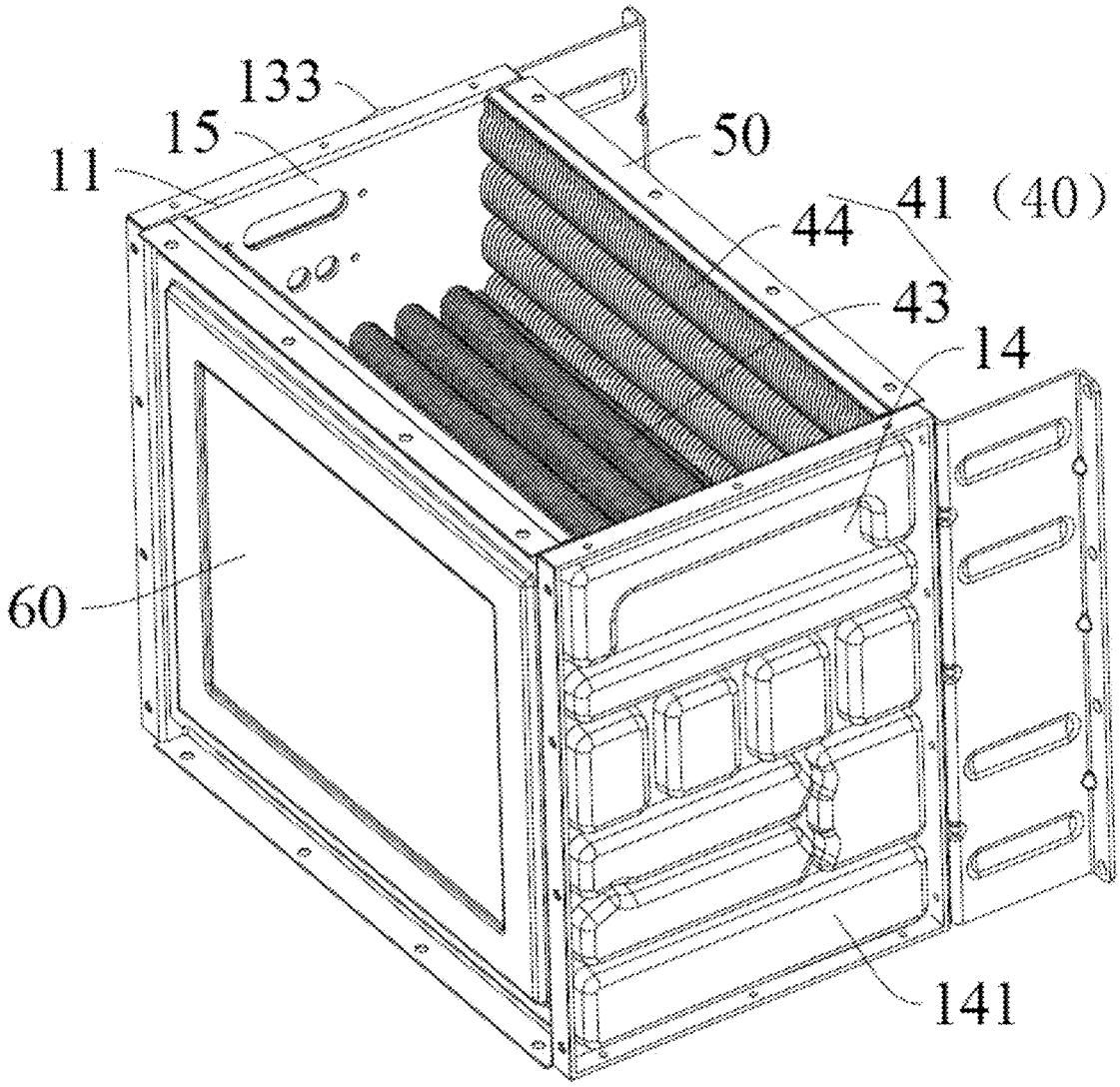
FIG. 3 is another schematic view of a water tank assembly of a heating device according to an embodiment of the present disclosure in another direction.
Figure 4:
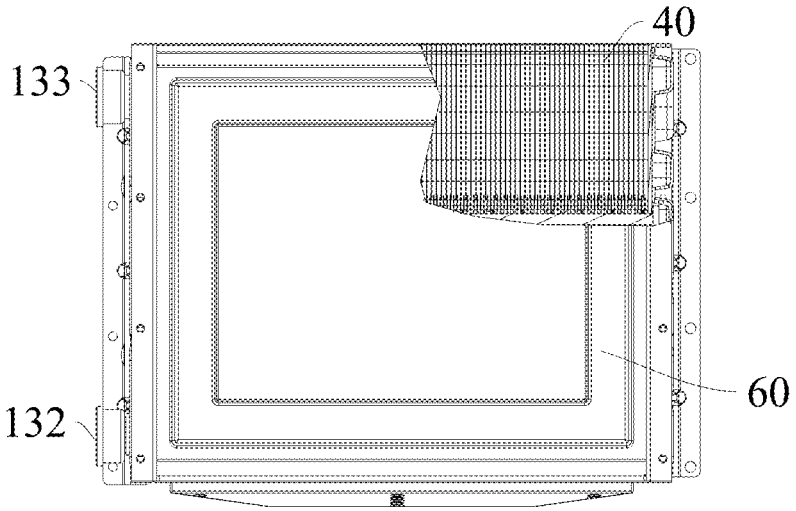
FIG. 4 is a partial sectional view of a water tank assembly of a heating device according to an embodiment of the present disclosure.

A water outlet 133 and a water inlet 132 are formed on the first side plate assembly 17. The water inlet 132 is in communication with one of first water boxes 131. The water outlet 133 is in communication with one of first water boxes 131. Further, as illustrated in FIG. 2, in an up-down direction in FIG. 2, some of first water boxes 131 are located at a same level, and some of first water boxes 131 are located at different levels. The water outlet 133 is located at a higher level than the water inlet 132. That is, the water outlet 133 is disposed above the water inlet 132. As illustrated in FIG. 3, in an up-down direction in FIG. 3, some of second water boxes 141 are located at a same level, and some of second water boxes 141 are located at different levels.

Further, the second side plate assembly 18 may include a second side plate 14. The first side plate assembly 17 may include a first side plate 13. Both the second side plate 14 and the first side plate 13 may be formed as integrated pieces. The second side plate 14 is formed as an integrated piece. That is, both the first side plate 13 and the second side plate 14 are formed as the integrated pieces. With this arrangement, it is possible to facilitate manufacturing and production of the second side plate 14 and the first side plate 13, and improve manufacturing efficiency of the second side plate 14 and the first side plate 13. Thus, manufacturing efficiency of the water tank assembly 100 can be improved. In addition, the number of molds developed to manufacture the tank body 10 can be reduced, and manufacturing costs of the tank body 10 can be lowered. As a result, manufacturing cost of the water tank assembly 100 can be lowered.

Further, as shown in FIG. 2, first water boxes 131 may be defined on the first side plate 13. Second water box 141 may be defined on the second side plate 14. The water outlet 133 and the water inlet 132 are formed on the first side plate 13.

The condensation pipe assembly 30 is located at a side of the main heat exchange pipe assembly 20 facing towards the smoke outlet 12. It should also be understood that, in the up-down direction in FIG. 2, the main heat exchange pipe assembly 20 is disposed at an upper side of the condensation pipe assembly 30. Second water boxes 141 and first water boxes 131 are in communication with each other via the condensation pipe assembly 30 and the main heat exchange pipe assembly 20. The main heat exchange pipe assembly 20 includes first heat exchange pipes 21. The condensation pipe assembly 30 includes second heat exchange pipes 31. Every two of first heat exchange pipes 21 are formed as a reciprocating heat exchange group. First heat exchange pipes 21 is formed as reciprocating heat exchange groups, and each reciprocating heat exchange group is in communication with one of first water boxes 131 and two of second water boxes 141, to form a series water passageway. It should be noted that one end of a first one of the first heat exchange pipes 21 in the reciprocating heat exchange group is in communication with one of first water boxes 131, and the other end of the first one of the first heat exchange pipes 21 is in communication with one of the two second water boxes 141. An end of a second one of the first heat exchange pipes 21 in the reciprocating heat exchange group is in communication with the other one of the two second water boxes 141. The second water box 141 in communication with the first one of the first heat exchange pipes 21 is communication with the second water box 141 in communication with the second one of the first heat exchange pipes 21. After flowing into the first one of the first heat exchange pipes 21 from the first water box 131, the water may flow into the second water box 141 in communication with the first one of the first heat exchange pipes 21. Then, the water flows into the other one of the two second water boxes 141 from the second water box 141 in communication with the first one of the first heat exchange pipes 21, and then flows into the second one of the first heat exchange pipes 21. A cross section of each first heat exchange pipe 21 is of an elongated shape, and no disturbance member is provided for each of the first heat exchange pipes 21. Cold water may flow into the first water boxes 131 from the water inlet 132, flow upwards through the first water boxes 131 and the second water boxes 141 on both sides layer by layer after flowing through the second heat exchange pipe 31, and then flow through the first heat exchange pipes 21. Finally, hot water flows out of the water outlet 133.

After the high temperature smoke generated through the combustion in the burner flows into the tank body 10 from the smoke inlet 11, the high temperature smoke in the tank body 10 flows through the main heat exchange pipe assembly 20. Heat from the high temperature smoke is transferred to the cold water in the first heat exchange pipes 21. The cold water in the first heat exchange pipes 21 absorbs heat and is converted into hot water. Then, the smoke flowing through the main heat exchange pipe assembly 20 flows through the second heat exchange pipes 31 of the condensation pipe assembly 30. Cold water in the second heat exchange pipes 31 absorbs heat and is converted into hot water. The smoke can exchange heat with the condensation pipe assembly 30 to generate condensed water, and the condensed water can be discharged from the smoke outlet 12. In the present disclosure, each reciprocating heat exchange group can be in communication with one of first boxes 131 and two of second boxes 132 to form the series water passageway. That is, a water passageway of a high temperature heat exchange segment has a series connection structure. That is, water passageways in the water tank assembly 100 are connected in series as one water passageway. Therefore, non-uniform distribution of a water flow rate and a water flow velocity within the water passageways will not occur. Compared with the related art, in the present disclosure, the water flow rate or the water flow velocity in the main heat exchange pipe assembly 20 and the condensation pipe assembly 30 is more uniform, and water vaporization and scaling in the condensation pipe assembly 30 and the main heat exchange pipe assembly 20 can be alleviated, to reduce a risk of damages to the first heat exchange pipes 21 and the second heat exchange pipes 31. As a result, service lives of the water tank assembly 100 and the heating device 200 can be prolonged.

In addition, if flowing in the first heat exchange pipes 21 at a relatively low flow velocity with relatively high flow resistance, the water will be easily vaporized in the first heat exchange pipes 21 or scale will be formed in the first heat exchange pipes 21, which may affect use performance and a service life of the heating device 200. Therefore, by designing each of the first heat exchange pipes 21 into the elongated structure and providing no disturbance member in each of the first heat exchange pieces 21, the flow resistance of the water in the first heat exchange pipe 21 can be effectively reduced when the water flows in the first heat exchange pipes 21, which can further avoid deposition of insoluble substances in the first heat exchange pipes 21. As a result, it is possible to avoid vaporization of the water in the first heat exchange pipes 21, and alleviate the formation of the scale in the first heat exchange pipes 21, to further avoid blockage of the first heat exchange pipes 21 and the second heat exchange pipes 31. Therefore, it is possible to prevent a dry burn and a rupture from occurring to the heating device 200, to improve the use performance of the heating device 200 and prolonging the service life of the heating device 200.

Further, at least some of the first heat exchange pipes 21 and/or at least some of the second heat exchange pipes 31 pass through the heat exchange fin assembly 40. That is, it is possible for at least some of first heat exchange pipes 21 to pass through the heat exchange fin assembly 40, or it is possible for at least some of second heat exchange pipes 31 to pass through the heat exchange fin assembly 40, or it is possible for both the first heat exchange pipes 21 and the second heat exchange pipes 31 to pass through the heat exchange fin assembly 40. The heat exchange fin assembly 40 may be disposed in the tank body 10. After the high temperature smoke generated through the combustion in the burner flows into the tank body 10 from the smoke inlet 11, heat from the high temperature smoke may be transferred to the first heat exchange pipes 21 and/or the second heat exchange pipes 31 via the heat exchange fin assembly 40. In this way, more heat can be transferred to the cold water in the first heat exchange pipes 21 and/or the second heat exchange pipes 31. As a result, heat exchange efficiency can be improved. Thus, the cold water can be converted into the hot water more quickly, which in turn improves heat exchange efficiency of the water tank assembly 100 and operation performance of the heating device 200.

Therefore, by communicating each reciprocating heat exchange group with one of first water boxes 131 and two of second water boxes 141 to form one series water passageway, shaping the cross section of each of first heat exchange pipes 21 into the elongated shape, and providing no disturbance member in each of the first heat exchange pipes 21, compared with the related art, in the present disclosure, the water flow rate or the water flow velocity in the main heat exchange pipe assembly 20 and the condensation pipe assembly 30 is more uniform. Further, the water vaporization and the scaling in the condensation pipe assembly 30 and the main heat exchange pipe assembly 20 can be alleviated. Also, flow resistance of the water in the first heat exchange pieces 21 can be reduced. As a result, it is possible to avoid the blockage of the first heat exchange pipes 21 and the second heat exchange pipes 31, to prevent the dry burn and the rupture from occurring to the heating device 200. Therefore, the service lives of the water tank assembly 100 the heating device 200 can be prolonged.

Figure 6:
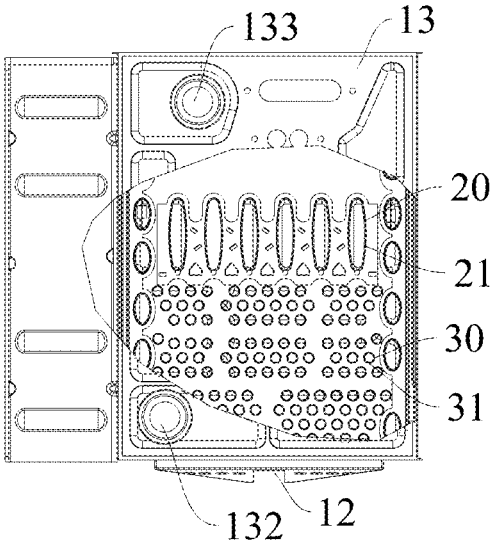
FIG. 6 is a partial sectional view of a side plate assembly of a water tank assembly of a heating device according to an embodiment of the present disclosure.

In some embodiments of the present disclosure, as shown in FIG. 6, first heat exchange pipes 21 is arranged in one layer and passes through the heat exchange fin assembly 40. The heat exchange fin assembly 40 is supported on the condensation pipe assembly 30. After the high temperature smoke generated through the combustion in the burner flows into the tank body 10 from the smoke inlet 11, the heat from the high temperature smoke may be transferred to the heat exchange fin assembly 40. Then, the heat exchange fin assembly 40 may transfer heat to the first heat exchange pipes 21 and the second heat exchange pipes 31. In this way, more heat can be transferred to the cold water in the first heat exchange pipes 21 and/or the second heat exchange pipes 31. As a result, heat exchange efficiency can be improved. Thus, the cold water can be converted into the hot water more quickly, which in turn improves heat exchange efficiency of the water tank assembly 100 and operation performance of the heating device 200.

In some embodiments of the present disclosure, first heat exchange pipes 21 is arranged in layers. First heat exchange pipes 21 in layers is arranged in a direction from the smoke inlet 11 to the smoke outlet 12. The direction from the smoke inlet 11 to the smoke outlet 12 refers to the up-down direction in FIG. 2. A first layer of heat exchange pipes is a layer of heat exchange pipes closest to the smoke inlet 11. The first layer of heat exchange pipes is in communication with corresponding first water boxes 131 and corresponding second water boxes 141 to form one series water passageway. Each of the first layer of heat exchange pipes 22 has one end in communication with the corresponding first water boxes 131 and the other end in communication with the corresponding second water boxes 141.

In some embodiments of the present disclosure, as shown in FIG. 2 and FIG. 6, each first water box 131 in communication with the condensation pipe assembly 30 is communication with at least three of the second heat exchange pipes 31. In this way, the water in the first water boxes 131 can quickly flow into second heat exchange pipes 31, and the water in second heat exchange pipes 31 can also flow into the first water boxes 131 simultaneously. As a result, it is possible to shorten flow duration of the water in the condensation pipe assembly 30, to avoid the water vaporization or the scale formation in the condensation pipe assembly 30. Also, water flow resistance in the second heat exchange pipes 31 can be reduced to avoid the blockage of the second heat exchange pipes 31. Therefore, it is possible to further prevent the dry burn and the rupture from occurring to the heating device 200, to prolong the service life of each of the water tank assembly 100 and heating device 200.

In some embodiments of the present disclosure, as shown in FIG. 6, each second heat exchange pipe 31 is formed as a circular pipe. That is, a cross-sectional shape of each second heat exchange pipe 31 is circular. In addition, second heat exchange pipes 31 corresponding to each first water box 131 is arranged in rows and columns. With this arrangement, second heat exchange pipes 31 has more compact structure, to reduce a volume of the water tank assembly 100, which in turn reduces a volume of the heating device 200.

In some embodiments of the present disclosure, as illustrated in FIG. 2, FIG. 3, and FIG. 6, the heat exchange fin assembly 40 may include first fins 41 arranged sequentially in a length direction of the first heat exchange pipe 21. The length direction of the first heat exchange pipe 21 refers to the left-right direction in FIG. 2. Each first fin 41 may have a first through hole 42, i.e., a through hole 42. The first through hole 42 penetrates the first fin 41 in a thickness direction of the first fin 41. The first heat exchange pipe 21 passes through the first through hole 42. In this way, the embodiment that the first heat exchange pipe 21 passes through the first fin 41 can be realized to prevent separation of the first fin 41 from the first heat exchange pipe 21. As a result, heat exchange between the first heat exchange pipe 21 and the first fin 41 can be ensured. In addition, by providing first fins 41, heat exchange efficiency between the heat exchange fin assembly 40 and the first heat exchange pipe 21 can be improved.

Figure 8:
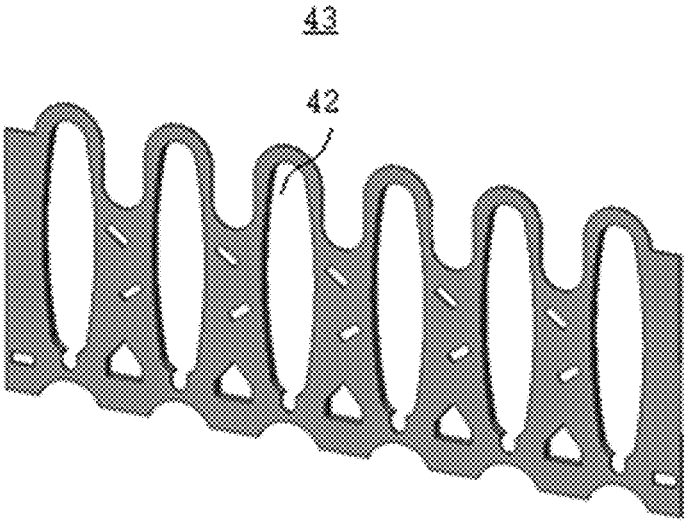
FIG. 8 is a schematic view of a first sub-fin of a water tank assembly of a heating device according to an embodiment of the present disclosure.
Figure 9:
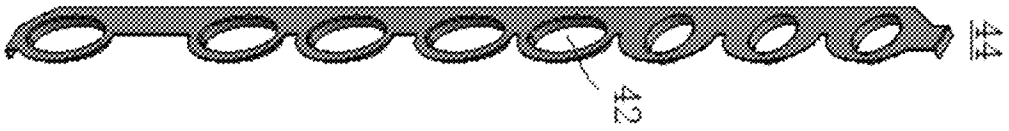
FIG. 9 is a schematic view of a second sub-fin of a water tank assembly of a heating device according to an embodiment of the present disclosure.

In some embodiments of the present disclosure, as illustrated in FIG. 2, FIG. 8, and FIG. 9, the first fin 41 includes a first sub-fin 43 and a second sub-fin 44. The first sub-fin 43 may be sleeved over the first heat exchange pipe 21, and the second sub-fin 44 may also be sleeved over the first heat exchange pipe 21. Also, the second sub-fin 44 is disposed on a side wall of the tank body 10. For example, the second sub-fin 44 is disposed on an inner surface of a first heat insulation plate 50. In this way, it is possible to enlarge a heat exchange area of the heat exchange fin assembly 40.

In some embodiments of the present disclosure, the water tank assembly 100 may be made of a stainless steel material. In this way, it is possible to effectively enhance corrosion resistance of the water tank assembly 100, to further prolong the service life of the water tank assembly 100.

In some embodiments of the present disclosure, as illustrated in FIG. 2, the tank body 10 may further include a second heat insulation plate 60 and a first heat insulation plate 50. The second heat insulation plate 60 is opposite to the first heat insulation plate 50. The first heat insulation plate 50 is engaged with and connected to the first side plate assembly 17 and the second side plate assembly 18 respectively, and the second heat insulation plate 60 is engaged with and connected to the first side plate assembly 17 and the second side plate assembly 18 respectively. Further, the first heat insulation plate 50 is engaged with and connected to the second side plate 14 of the second side plate assembly 18 and the first side plate 13 of the first side plate assembly 17 respectively, and the second heat insulation plate 60 is engaged with and connected to the second side plate 14 and the first side plate 13 respectively. Further, as illustrated in FIG. 2, the first heat insulation plate 50 has a left end connected to the first side plate 13 and a right end connected to the second side plate 14. The second heat insulation plate 60 has a left end connected to the first side plate 13 and a right end connected to the second side plate 14. The second heat insulation plate 60 and the first heat insulation plate 50 can provide heat insulation. After the high temperature smoke generated through the combustion in the burner flows into the tank body 10 from the smoke inlet 11, it is possible to prevent the heat from being transferred to an outside of the tank body 10 through the second heat insulation plate 60 and the first heat insulation plate 50. Thus, dissipation of the heat from the second heat insulation plate 60 and the first heat insulation plate 50 can be avoid, which can ensure the heat exchange efficiency of the water tank assembly 100. Therefore, heating efficiency of the heating device 200 can be ensured.

Further, each of the second heat insulation plate 60 and the first heat insulation plate 50 may be formed as an integrated piece. The integrated piece has high structural strength, and thus structural strength of the second heat insulation plate 60 and the first heat insulation plate 50 can be enhanced. As a result, it is possible to avoid a deformation of the tank body 10. In addition, manufacturing and production of the second heat insulation plate 60 and the first heat insulation plate 50 can be facilitated to improve the manufacturing efficiency of the second heat insulation plate 60 and the first heat insulation plate 50, which can further improve the manufacturing efficiency of the water tank assembly 100. In one embodiment, the number of molds developed to manufacture the tank body 10 can be reduced, which further lowers manufacturing cost of the tank body 10. Therefore, the manufacturing cost of the water tank assembly 100 can be lowered.

Figure 5:
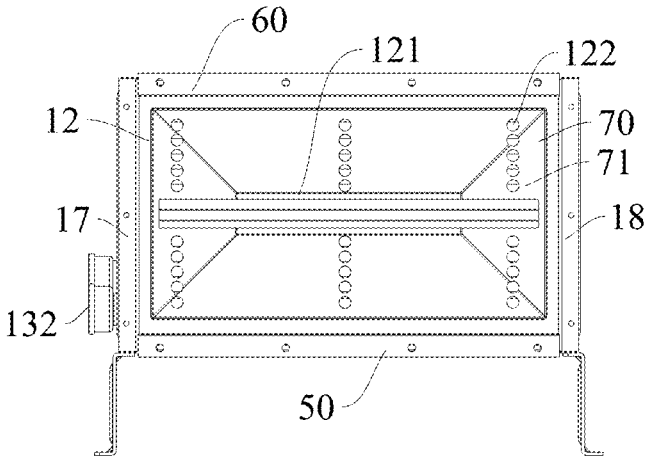
FIG. 5 is a bottom view of a water tank assembly of a heating device according to an embodiment of the present disclosure.

In some embodiments of the present disclosure, as illustrated in FIG. 5, the tank body 10 may further include a smoke baffle 70. The smoke baffle 70 is located at a side of the condensation pipe assembly 30 away from the main heat exchange pipe assembly 20. In the up-down direction in FIG. 2, the condensation pipe assembly 30 is disposed between the smoke baffle 70 and the main heat exchange pipe assembly 20. The smoke baffle 70 is disposed below the condensation pipe assembly 30. The smoke baffle 70 may be formed as an integrated piece. That is, the smoke baffle 70 is formed as an integrated piece. The smoke baffle 70 is engaged with and connected to the second side plate 14, the first side plate 13, the second heat insulation plate 60, and the first heat insulation plate 50. The smoke outlet 12 may be formed on the smoke baffle 70. As illustrated in FIG. 5, the smoke baffle 70 is engaged with and connected to a lower end of each of the second side plate 14, the first side plate 13, the second heat insulation plate 60, and the first heat insulation plate 50. After the high temperature smoke generated through the combustion in the burner flows into the tank body 10 from the smoke inlet 11, the smoke baffle 70 can block the smoke when flowing to the smoke baffle 70, which can extend a duration for which the smoke flows out of the smoke outlet 12 to enable the smoke to stay longer in the tank body 10. In this way, a heat exchange duration of the high temperature smoke with the first heat exchange pipes 21, the second heat exchange pipes 31, and the heat exchange fin assembly 40 can be prolonged to allow the cold water to be heated through more heat, which reduces heat loss and improves the heating efficiency of the heating device 200.

In some embodiments of the present disclosure, as illustrated in FIG. 5, the smoke baffle 70 may include guide plates 71 facing away from the smoke inlet 11. The smoke outlet 12 includes a first channel 121. Ends of guide plates 71 facing away from the smoke inlet 11 are spaced apart from each other to define the first channel 121. The smoke in the tank body 10 can flow out of the tank body 10 through the first channel 121. In this way, the flow area of the smoke can be ensured to allow the smoke to flow out of the tank body 10 from the smoke outlet 12 smoothly, to avoid expansion damage to the tank body 10 due to an excessive pressure in the tank body 10. As a result, explosion of the tank body 10 can be avoided, which can improve the use safety of the heating device 200.

In some embodiments of the present disclosure, as shown in FIG. 5, the smoke outlet 12 may further include a second channel 122. Second channels 122 may be formed on each guide plate 71. The second channel 122 penetrates the guide plate 71 in a thickness direction of the guide plate 71. The smoke in the tank body 10 can flow out of the tank body 10 through the second channel 122. In this way, the flow area of the smoke can be enlarged to ensure the smoke in the tank body 10 to flow out of the tank body 10 through both the first channel 121 and the second channel 122. Further, it is also possible to ensure the smoke flows out of the tank body 10 from the smoke outlet 12 smoothly, to further avoid the expansion damage to the tank body 10 due to the excessive pressure in the tank body 10. As a result, the explosion of the tank body 10 can be further avoided, which can further improve the use safety of the heating device 200.

Figure 7:
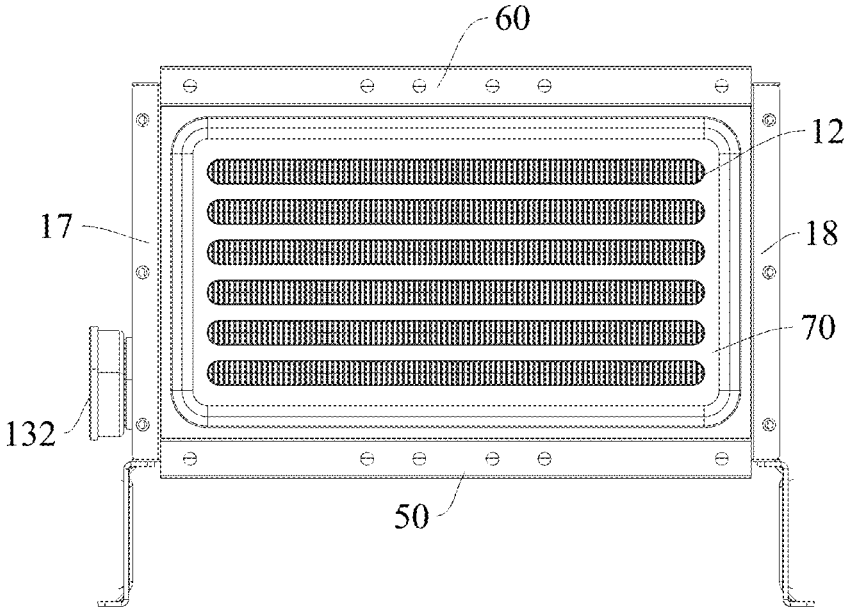
FIG. 7 is a schematic view of a smoke baffle of a water tank assembly of a heating device according to an embodiment of the present disclosure, in which a second through hole is formed on the smoke baffle.

In some embodiments of the present disclosure, as shown in FIG. 7, the smoke outlet 12 may include second through holes. Second through holes may each be formed into an elongated structure and arranged at intervals evenly. In this way, the flow area of the smoke can be ensured to ensure the smoke to flow out of the tank body 10 from the smoke outlet 12 smoothly, to avoid the expansion damage to the tank body 10 due to the excessive pressure in the tank body 10. The explosion of the tank body 10 can therefore be avoided, which can improve the use safety of the heating device 200. However, the present disclosure is not limited in this regard. The smoke outlet 12 may include through holes of a round shape, an elliptic shape, a trapezoidal shape, or other shapes, as long as the shape of the through hole can function as the elongated shape.

In some embodiments of the present disclosure, first water boxes 131 are opened at a same side, and second water boxes 141 are opened at a same side. Further, each of first water boxes 131 have an open side facing towards an inside of the tank body 10, and each of second water boxes 141 have an open side facing towards the inside of the tank body 10. As illustrated in FIG. 2, first water boxes 131 are opened at a right side, and second water boxes 141 are opened at a left side. The second side plate assembly 18 may further include a second bottom plate 16. The first side plate assembly 17 may further include a first bottom plate 15. Each of the first bottom plate 15 and the second bottom plate 16 may be formed as an integrated piece. The first bottom plate 15 can be engaged with the first side plate 13 to cover the open side of each of first water boxes 131. The second bottom plate 16 can be engaged with the second side plate 14 to cover the open side of each of second water boxes 141.

Further, first bottom plates 15 may be provided and arranged in one-to-one correspondence to first water boxes 131. Second bottom plates 16 may be provided and arranged in one-to-one correspondence to second bottom plates 16. A mounting hole is formed on each of first bottom plates 15 and on each of second bottom plates 16. The mounting hole of the first bottom plate 15 penetrates the first bottom plate 15, and the mounting hole of the second bottom plate 16 penetrates the second bottom plates 16. The first heat exchange pipes 21 and the second heat exchange pipes 31 each are mounted in the corresponding mounting holes. In this way, it can be ensured that water in the first water boxes 131 flows into the first heat exchange pipes 21 and the second heat exchange pipes 31. Also, it is possible to ensure that water in the second water boxes 141 flows into the first heat exchange pipes 21 and the second heat exchange pipes 31. Thus, it is possible to prevent the water from flowing out of the open sides of the first water boxes 131 and the open sides of the second water boxes 141, avoiding water leakage of the water tank assembly 100.

First bottom plates 15 may be formed into an integral plate-like structure. One first bottom plates 15 can cover the open sides of first water boxes 131 simultaneously. Second bottom plates 16 may be formed into an integral plate-like structure. One second bottom plate 16 can cover the open sides of second water boxes 141 simultaneously.

In some embodiments of the present disclosure, the second heat exchange pipe 31 may have an elliptic cross section. Further, the second heat exchange pipe 31 has an elliptic cross section. That is, the cross section of the second heat exchange pipe 31 is of an elliptic shape. If flowing in the second heat exchange pipe 31 at a relatively low flow velocity with relatively high flow resistance, the water will be easily vaporized in the second heat exchange pipe 31 or scale will be formed in the second heat exchange pipe 31, which may affect use performance and a service life of the heating device 200. Therefore, by designing the second heat exchange pipe 31 to have the elliptic cross section, the flow resistance of the water in the second heat exchange pipe 31 can be reduced when the water flows in the second heat exchange pipe 31, which can avoid deposition of insoluble substances in the second heat exchange pipe 31. As a result, it is possible to avoid vaporization of the water in the second heat exchange pipe 31, and alleviate the formation of the scale in the second heat exchange pipe 31, to improve the use performance of the heating device 200 and prolonging the service life of the heating device 200. However, the present disclosure is not limited in this regard. The second heat exchange pipe 31 may have other irregularly-shaped cross sections, as long as the cross section of the second heat exchange pipe 31 can function as the elliptic cross section.

In some embodiments of the present disclosure, as illustrated in FIG. 6, at least some of first heat exchange pipes 21 each have an elliptic cross section. If flowing in the first heat exchange pipes 21 at a relatively low flow velocity with relatively high flow resistance, the water will be easily vaporized in the first heat exchange pipe 21 or scale will be formed in the first heat exchange pipe 21, which may affect the use performance and the service life of the heating device 200. Therefore, by designing each of the at least some of first heat exchange pipes 21 to have the elliptic cross section, the flow resistance of the water in the first heat exchange pipes 21 can be reduced when the water flows in the first heat exchange pipes 21, which can avoid deposition of the insoluble substances in the first heat exchange pipes 21. As a result, it is possible to avoid vaporization of the water in the first heat exchange pipes 21, and alleviate the formation of the scale in the first heat exchange pipes 21, to further improve the use performance of the heating device 200 and prolonging the service life of the heating device 200. However, the present disclosure is not limited in this regard. The first heat exchange pipe 21 may have other irregularly-shaped cross sections, as long as the cross section of the first heat exchange pipe 21 can function as the elliptic cross section.

In some embodiments of the present disclosure, first heat exchange pipes 21 is arranged in two layers in the direction from the smoke inlet 11 to the smoke outlet 12. Some of first heat exchange pipes 21 in a first layer of heat exchange pipes each have an elliptic cross section, and the rest of first heat exchange pipes 21 in the first layer of heat exchange pipes each have a circular cross section. A second layer of heat exchange pipes is disposed below the first layer of heat exchange pipes 22. Each first heat exchange pipe 21 in the second layer of heat exchange pipes has an elliptic cross section. When the water flows in first heat exchange pipes 21, the flow resistance of the water in the first heat exchange pipes 21 can be further reduced, which can further avoid the deposition of the insoluble substances in the first heat exchange pipes 21. As a result, it is possible to further avoid the vaporization of the water in the first heat exchange pipes 21, and further alleviate the formation of the scale in the first heat exchange pipes 21, to further improve the use performance of the heating device 200 and prolonging the service life of the heating device 200.

In some embodiments of the present disclosure, a disturbance member may be disposed on the heat exchange fin assembly 40. The disturbance member is configured to divert the smoke in the tank body 10. After the high temperature smoke generated through the combustion in the burner flows into the tank body 10 from the smoke inlet 11, the smoke in the tank body 10 can be diverted by the disturbance member to prolong movement duration of the smoke in the tank body 10. Thus, sufficient heat exchange can be performed between the smoke and the heat exchange fin assembly 40, the first heat exchange pipes 21, and the second heat exchange pipes 31, which in turn can enhance the heating efficiency of the heating device 200 and improve the operation performance of the heating device 200.

In some embodiments of the present disclosure, the disturbance member may include a flange disposed on the heat exchange fin assembly 40. In this way, a structure of the disturbance member can be simplified to facilitate manufacturing and production of the disturbance member, to improve manufacturing efficiency of the disturbance member. Further, the disturbance member and the heat exchange fin assembly 40 may be integrally formed. That is, the disturbance member and the heat exchange fin assembly 40 are provided as an integrated piece. In this way, the number of parts for forming the water tank assembly 100 can be reduced. Thus, assembly efficiency of the water tank assembly 100 can be improved, to improve the manufacturing efficiency of the water tank assembly 100.

As illustrated in FIG. 1 to FIG. 15, a water tank assembly 100 according to an embodiment of the present disclosure includes a tank body 10, a main heat exchange pipe assembly 20, a heat exchange fin assembly 40, a condensation pipe assembly 30, and fire-side heat exchange pipes 80. The tank body 10 has a smoke outlet 12 and a smoke inlet 11. A burner may be provided for the heating device 200. High temperature smoke generated through combustion in the burner may flow into the tank body 10 from the smoke inlet 11. The high temperature smoke in the tank body 10 may flow out of the tank body 10 from the smoke outlet 12. The tank body 10 includes a first side plate assembly 17. The tank body 10 also includes a second side plate assembly 18 opposite to the side plate assembly 17. Further, the second side plate assembly 18 is opposite to the side plate assembly 17 in a first direction of the water tank assembly 100. The first direction of the water tank assembly 100 may refer to a left-right direction in FIG. 10. Also, the second side plate assembly 18 and the first side plate assembly 17 are spaced apart from each other in the first direction of the water tank assembly 100. First water boxes 131 is defined by the first side plate assembly 17. Second water boxes 141 is defined by the second side plate assembly 18.

Figure 10:
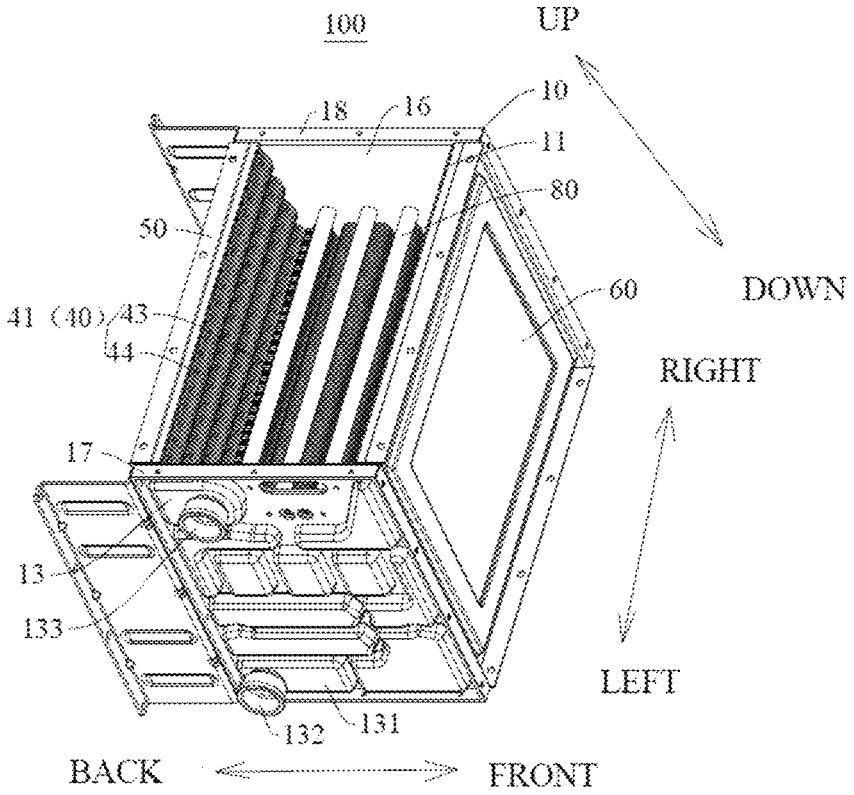
FIG. 10 is a schematic view of a water tank assembly of a heating device according to an embodiment of the present disclosure, in which the water tank assembly is provided with a fire-side heat exchange pipe.
Figure 11:
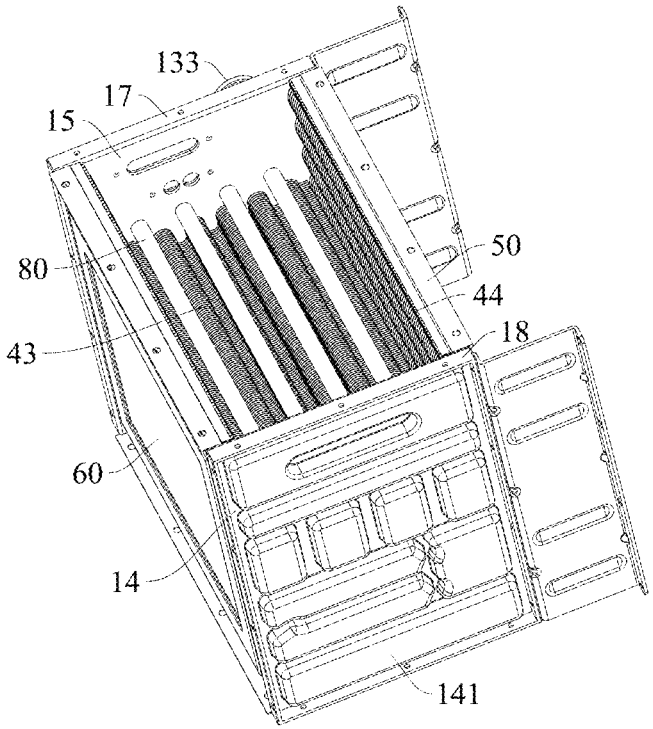
FIG. 11 is another schematic view of the water tank assembly of the heating device according to an embodiment of the present disclosure in another direction, in which the water tank assembly is provided with the fire-side heat exchange pipe.
Figure 12:
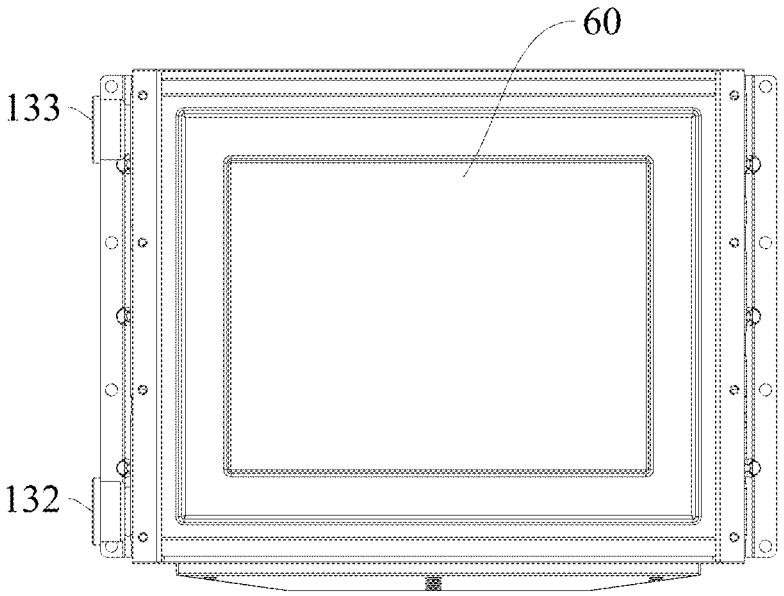
FIG. 12 is a side view of a water tank assembly of a heating device according to an embodiment of the present disclosure.

A water outlet 133 and a water inlet 132 are formed on the first side plate 13. The water inlet 132 is in communication with one of first water boxes 131. The water outlet 133 is in communication with one of first water boxes 131. In an example, the water inlet 132 is in communication with one first water box 131, and the water outlet 133 is in communication with another first water box 131. Further, as illustrated in FIG. 10, in an up-down direction in FIG. 10, some of first water boxes 131 are located at a same level, and some of first water boxes 131 are located at different levels. The water outlet 133 is located at a higher level than the water inlet 132. That is, the water outlet 133 is disposed above the water inlet 132. As illustrated in FIG. 11, in an up-down direction in FIG. 11, some of second water boxes 141 are located at a same level, and some of second water boxes 141 are located at different levels.

Further, the second side plate assembly 18 may include the second side plate 14, and the first side plate assembly 17 may include the first side plate 13. Each of the second side plate 14 and the first side plate 13 is formed as an integrated piece. The second side plate 14 is formed as an integrated piece. That is, both the first side plate 13 and the second side plate 14 are formed as integrated piece. In this way, it is possible to facilitate manufacturing and production of the second side plate 14 and the first side plate 13, and improve manufacturing efficiency of the second side plate 14 and the first side plate 13. Thus, manufacturing efficiency of the water tank assembly 100 can be improved. In addition, the number of molds developed to manufacture the tank body 10 can be reduced, and manufacturing costs of the tank body 10 can be lowered. As a result, manufacturing cost of the water tank assembly 100 can be lowered.

Further, as illustrated in FIG. 10, first water boxes 131 are disposed on the first side plate 13. second water boxes 141 are disposed on the second side plate 14. The water outlet 133 and the water inlet 132 are formed on the first side plate 13.

Fire-side heat exchange pipes 80 are provided at a side of the main heat exchange pipe assembly 20 facing towards the smoke inlet 11, and the condensation pipe assembly 30 is located at a side of the main heat exchange pipe assembly 20 facing towards the smoke outlet 12. It can also be understood that, in the up-down direction in FIG. 10, fire-side heat exchange pipes 80 are provided at an upper side of the main heat exchange pipe assembly 20, and the main heat exchange pipe assembly 20 is provided at an upper side of the condensation pipe assembly 30. Each of the main heat exchange assembly 20, the condensation pipe assembly 30, and fire-side heat exchange pipes 80 is in communication with the first water boxes 131 and the second water boxes 141. That is, second water boxes 141 and first water boxes 131 are in communication with fire-side heat exchange pipes 80 through the main heat exchange pipe assembly 20 and the condensation pipe assembly 30. No heat exchange fin is provided for each of the fire-side heat exchange pipes 80, and each fire-side heat exchange pipe 80 has a circle cross section.

The high temperature smoke generated through the combustion in the burner flows into the tank body 10 from the smoke inlet 11. The high temperature smoke in the tank body 10 flows through the fire-side heat exchange pipes 80, and then flows through the main heat exchange 20. Heat from the high temperature smoke is transferred to cold water in the main heat exchange pipe assembly 20. The cold water in the main heat exchange pipe assembly 20 absorbs heat and is converted into hot water. Then, the smoke flowing through the main heat exchange pipe assembly 20 flows through the condensation pipe assembly 30. Cold water in the condensation pipe assembly 30 absorbs heat and is converted into hot water. The smoke can exchange heat with the condensation pipe assembly 30 to generate condensed water, and the condensed water is discharged from the smoke outlet 12. In the present disclosure, by arranging fire-side heat exchange pipes 80 at the side of the main heat exchange pipe assembly 20 facing towards the smoke inlet 11, it is possible for fire-side heat exchange pipes 80 to slow down the flow velocity of the high temperature smoke to extend a flow duration of the smoke in the tank body 10. As a result, a heat exchange duration for the high temperature smoke with the fire-side heat exchange pipes 80, the main heat exchange pipe assembly 20, and the condensation pipe assembly 30 can be extended, which in turn improves the heat exchange efficiency of the water tank assembly 100. In one embodiment, fire-side heat exchange pipes 80 can be resistant to an impact of the high temperature smoke. As a result, fire-side heat exchange pipes 80 can share a part of heat loads of the main heat exchange pipe assembly 20, and buffer the impact of the high temperature smoke on the main heat exchange pipe assembly 20. Therefore, it is possible to avoid the damage to the main heat exchange pipe assembly 20, to prolong the service life of the water tank assembly 100.

Further, the main heat exchange pipe assembly 20 passes through the heat exchange fin assembly 40. The heat exchange fin assembly 40 may be provided in the tank body 10. The high temperature smoke generated through the combustion in the burner flows into the tank body 10 from the smoke inlet 11. Heat from the high temperature smoke can be transferred to the main heat exchange pipe assembly 20 through the heat exchange fin assembly 40. In this way, more heat can be transferred to the cold water in the main heat exchange pipe assembly 20. As a result, the heat exchange efficiency can be improved. Thus, the cold water can be converted into the hot water more quickly, which in turn improves the heat exchange efficiency of the water tank assembly 100 and operation performance of the heating device 200. In addition, by designing the cross-sectional shape of each fire-side heat exchange pipe 80 to be circular, the fire-side heat exchange pipe 80 has a smooth outer surface. As a result, the high temperature smoke can flow through the fire-side heat exchange pipes 80 smoothly, to prevent a noise from being generated in the tank assembly 100.

Therefore, by providing the fire-side heat exchange pipes 80 and the heat exchange fin assembly 40, the heat exchange efficiency between the high temperature smoke and the water tank assembly 100 can be improved. Also, the impact of the high temperature smoke on the main heat exchange pipe assembly 20 can be reduced, which can extend the service life of the water tank assembly 100.

In some embodiments of the present disclosure, no disturbance member is provided in each of the fire-side heat exchange pipes 80. If flowing in the fire-side heat exchange pipes 80 at a relatively low flow velocity with relatively high resistance, the water will be easily vaporized in the fire-side heat exchange pipes 80 or scale will be formed in the fire-side heat exchange pipes 80, which may affect use performance and a service life of the heating device 200. Therefore, by providing no disturbance member in each fire-side heat exchange pipe 80, the flow resistance of the water in the heat exchange pipes 80 can be effectively reduced when flowing in the heat exchange pipes 80, which can avoid deposition of the insoluble substances in the fire-side heat exchange pipes 80. As a result, it is possible to avoid vaporization of the water in the fire-side heat exchange pipes 80, and alleviate the formation of the scale in the fire-side heat exchange pipes 80, to avoid blockage of the fire-side heat exchange pipes 80. Therefore, it is possible to prevent a dry burn and a rupture from occurring to the heating device 200, to improve the use performance of the heating device 200 and prolonging the service life of the heating device 200.

In some embodiments of the present disclosure, the main heat exchange pipe assembly 20 may include first heat exchange pipes 21. That is, first heat exchange pipes 21 is provided. A cross section of each first heat exchange pipe 21 is of an elongated shape, and no disturbance member is provided for each of the first heat exchange pipes 21. Cold water may flow into the first water boxes 131 from the water inlet 132, flow upwards through the first water boxes 131 and the second water boxes 141 on both sides layer by layer after flowing through the condensation pipe assembly 30, and then flow through the first heat exchange pipes 21. Finally, hot water flows out of the water outlet 133. In addition, if flowing in the first heat exchange pipes 21 at a relatively low flow velocity with relatively high flow resistance, the water will be easily vaporized in the first heat exchange pipes 21 or scale will be formed in the first heat exchange pipes 21, which may affect use performance and the service life of the heating device 200. Therefore, by designing each of the first heat exchange pipes 21 into the elongated structure and providing no disturbance member in each of the first heat exchange pieces 21, the flow resistance of the water in the first heat exchange pipes 21 can be effectively reduced when the water flows in the first heat exchange pipes 21, which can avoid deposition of the insoluble substances in the first heat exchange pipes 21. As a result, it is possible to avoid vaporization of the water in the first heat exchange pipes 21, and alleviate the formation of the scale in the first heat exchange pipes 21, to avoid blockage of the first heat exchange pipes 21. Therefore, it is possible to prevent a dry burn and a rupture from occurring to the heating device 200, to improve the use performance of the heating device 200 and prolonging the service life of the heating device 200.

Figure 15:
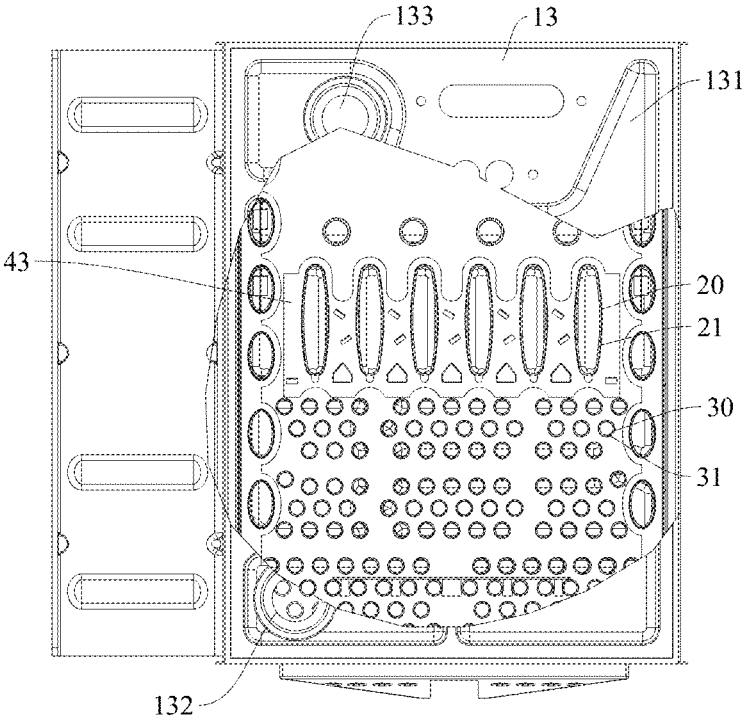
FIG. 15 is a partial sectional view of a first side plate assembly of a water tank assembly of a heating device according to an embodiment of the present disclosure.

In some embodiments of the present disclosure, as shown in FIG. 15, first heat exchange pipes 21 is arranged in one layer and passes through the heat exchange fin assembly 40. The heat exchange fin assembly 40 is supported on the condensation pipe assembly 30. After the high temperature smoke generated through the combustion in the burner flows into the tank body 10 from the smoke inlet 11, the heat from the high temperature smoke may be transferred to the heat exchange fin assembly 40. Then, the heat exchange fin assembly 40 may transfer heat to the first heat exchange pipes 21 and the second heat exchange pipes 31. In this way, more heat can be transferred to the cold water in the first heat exchange pipes 21 and/or the second heat exchange pipes 31. As a result, heat exchange efficiency can be improved. Thus, the cold water can be converted into the hot water more quickly, which in turn improves heat exchange efficiency of the water tank assembly 100 and operation performance of the heating device 200.

In some embodiments of the present disclosure, as shown in FIG. 15, the condensation pipe assembly 30 may include second heat exchange pipes 31. That is, second heat exchange pipes 31 is provided. Each first water box 131 in communication with the condensation pipe assembly 30 is communication with at least three of the second heat exchange pipes 31. In this way, the water in the first water boxes 131 can quickly flow into second heat exchange pipes 31, and the water in second heat exchange pipes 31 can also flow into the first water boxes 31 simultaneously. As a result, it is possible to shorten flow duration of the water in the condensation pipe assembly 30, to avoid the water vaporization or the scale formation in the condensation pipe assembly 30. Also, water flow resistance in the second heat exchange pipe 31 can be reduced to avoid the blockage of the second heat exchange pipes 31. Therefore, it is possible to further prevent the dry burn and the rupture from occurring to the heating device 200, to prolong the service life of each of the water tank assembly 100 and heating device 200.

In some embodiments of the present disclosure, as shown in FIG. 15, each second heat exchange pipe 31 is formed into a circular pipe. That is, a cross-sectional shape of each second heat exchange pipe 31 is circular. In addition, second heat exchange pipes 31 corresponding to each first water box 131 is arranged in rows and columns. With this arrangement, second heat exchange pipes 31 has a more compact structure, to reduce a volume of the water tank assembly 100, which in turn reduces a volume of the heating device 200.

In some embodiments of the present disclosure, every two of first heat exchange pipes 21 are formed as a reciprocating heat exchange group. First heat exchange pipes 21 is formed as reciprocating heat exchange groups, and each reciprocating heat exchange group is in communication with one of first water boxes 131 and two of second water boxes 141, to form a series water passageway. It should be noted that one end of a first one of the first heat exchange pipes 21 in the reciprocating heat exchange group is in communication with one of first water boxes 131, and the other end of the first one of the first heat exchange pipes 21 is in communication with one of the two second water boxes 141. An end of a second one of the first heat exchange pipes 21 in the reciprocating heat exchange group is in communication with the other one of the two second water boxes 141. The second water box 141 in communication with the first one of the first heat exchange pipes 21 is communication with the second water box 141 in communication with the second one of the first heat exchange pipes 21. After flowing into the first one of the first heat exchange pipes 21 from the first water box 131, the water may flow into the second water box 141 in communication with the first one of the first heat exchange pipes 21. Then, the water flows into the other one of the two second water boxes 141 from the second water box 141 in communication with the first one of the first heat exchange pipes 21, and then flows into the second one of the first heat exchange pipes 21.

In the present disclosure, each reciprocating heat exchange group can be in communication with one of first boxes 131 and two of second boxes 132 to form the series water passageway. That is, a water passageway of a high temperature heat exchange segment has a series connection structure. That is, water passageways in the water tank assembly 100 are connected in series as one water passageway, and the flow velocity of the water in the water passageway in the water tank assembly 100 is constant. Therefore, non-uniform distribution of a water flow rate and a water flow velocity within the water passageways will not occur. Compared with the related art, in the present disclosure, the water flow rate or the water flow velocity in the main heat exchange pipe assembly 20 and the condensation pipe assembly 30 is more uniform, and water vaporization and scaling in the condensation pipe assembly 30 and the main heat exchange pipe assembly 20 can be alleviated, to reduce a risk of damages to the first heat exchange pipes 21 and the second heat exchange pipes 31. As a result, service lives of the water tank assembly 100 and the heating device 200 can be prolonged.

Further, at least some of the first heat exchange pipes 21 and/or at least some of the second heat exchange pipes 31 pass through the heat exchange fin assembly 40. That is, it is possible for at least some of first heat exchange pipes 21 to pass through the heat exchange fin assembly 40, or it is possible for at least some of second heat exchange pipes 31 to pass through the heat exchange fin assembly 40, or it is possible for both the first heat exchange pipes 21 and the second heat exchange pipes 31 to pass through the heat exchange fin assembly 40. The heat exchange fin assembly 40 may be disposed in the tank body 10. After the high temperature smoke generated through the combustion in the burner flows into the tank body 10 from the smoke inlet 11, heat from the high temperature smoke may be transferred to the first heat exchange pipes 21 and/or the second heat exchange pipes 31 via the heat exchange fin assembly 40. In this way, more heat can be transferred to the cold water in the first heat exchange pipes 21 and/or the second heat exchange pipes 31. As a result, heat exchange efficiency can be improved. Thus, the cold water can be converted into the hot water more quickly, which in turn improves heat exchange efficiency of the water tank assembly 100 and operation performance of the heating device 200.

Therefore, by communicating each reciprocating heat exchange group with one of first water boxes 131 and two of second water boxes 141 to form one series water passageway, shaping the cross section of each of first heat exchange pipes 21 into the elongated shape, and providing no disturbance member in each of the first heat exchange pipes 21, compared with the related art, in the present disclosure, the water flow rate or the water flow velocity in the main heat exchange pipe assembly 20 and the condensation pipe assembly 30 is more uniform. Further, the water vaporization and the scaling in the condensation pipe assembly 30 and the main heat exchange pipe assembly 20 can be alleviated. Also, flow resistance of the water in the first heat exchange pieces 21 can be reduced. As a result, it is possible to avoid the blockage of the first heat exchange pipes 21 and the second heat exchange pipes 31, to prevent the dry burn and the rupture from occurring to the heating device 200. Therefore, the service lives of the water tank assembly 100 the heating device 200 can be prolonged.

In some embodiments of the present disclosure, first heat exchange pipes 21 may be arranged in layers. first heat exchange pipes 21 in layers is arranged in a direction from the smoke inlet 11 to the smoke outlet 12. The direction from the smoke inlet 11 to the smoke outlet 12 refers to the up-down direction in FIG. 10. A first layer of heat exchange pipes is a layer of heat exchange pipes closest to the smoke inlet 11. The first layer of heat exchange pipes is in communication with corresponding first water boxes 131 and corresponding second water boxes 141 to form one series water passageway. Each of the first layer of heat exchange pipes 22 has one end in communication with the corresponding first water boxes 131 and the other end in communication with the corresponding second water boxes 141.

In some embodiments of the present disclosure, as illustrated in FIG. 10 and FIG. 11, the heat exchange fin assembly 40 may include first fins 41 arranged sequentially in a length direction of the first heat exchange pipe 21. The length direction of the first heat exchange pipe 21 refers to the left-right direction in FIG. 10. Each first fin 41 may have a first through hole 42, i.e., a through hole 42. The first through hole 42 penetrates the first fin 41 in a thickness direction of the first fin 41. The first heat exchange pipe 21 passes through the first through hole 42. In this way, the embodiment that the first heat exchange pipe 21 passes through the first fin 41 can be realized to prevent separation of the first fin 41 from the first heat exchange pipe 21. As a result, heat exchange between the first heat exchange pipe 21 and the first fin 41 can be ensured. In addition, by providing first fins 41, heat exchange efficiency between the heat exchange fin assembly 40 and the first heat exchange pipe 21 can be improved.

In some embodiments of the present disclosure, as illustrated in FIG. 10, FIG. 8, and FIG. 9, the first fin 41 may include a first sub-fin 43 and a second sub-fin 44. The first sub-fin 43 may be sleeved over the first heat exchange pipe 21, and the second sub-fin 44 may also be sleeved over the first heat exchange pipe 21. Also, the second sub-fin 44 is disposed on a side wall of the tank body 10. For example, the second sub-fin 44 is disposed on an inner surface of a first heat insulation plate 50. In this way, it is possible to enlarge a heat exchange area of the heat exchange fin assembly 40.

In some embodiments of the present disclosure, the water tank assembly 100 may be made of a stainless steel material. In this way, it is possible to effectively enhance corrosion resistance of the water tank assembly 100, to further prolong the service life of the water tank assembly 100.

In some embodiments of the present disclosure, as illustrated in FIG. 10, the tank body 10 may further include a second heat insulation plate 60 and a first heat insulation plate 50. The second heat insulation plate 60 is opposite to the first heat insulation plate 50. The first heat insulation plate 50 is engaged with and connected to the first side plate assembly 17 and the second side plate assembly 18 respectively, and the second heat insulation plate 60 is engaged with and connected to the first side plate assembly 17 and the second side plate assembly 18 respectively. Further, the first heat insulation plate 50 is engaged with and connected to the second side plate 14 of the second side plate assembly 18 and the first side plate 13 of the first side plate assembly 17 respectively, and the second heat insulation plate 60 is engaged with and connected to the second side plate 14 and the first side plate 13 respectively. Further, as illustrated in FIG. 10, the first heat insulation plate 50 has a left end connected to the first side plate 13 and a right end connected to the second side plate 14. The second heat insulation plate 60 has a left end connected to the first side plate 13 and a right end connected to the second side plate 14. The second heat insulation plate 60 and the first heat insulation plate 50 can provide heat insulation. After the high temperature smoke generated through the combustion in the burner flows into the tank body 10 from the smoke inlet 11, it is possible to prevent the heat from being transferred to an outside of the tank body 10 through the second heat insulation plate 60 and the first heat insulation plate 50. Thus, dissipation of the heat from the second heat insulation plate 60 and the first heat insulation plate 50 can be avoid, which can ensure the heat exchange efficiency of the water tank assembly 100. Therefore, heating efficiency of the heating device 200 can be ensured.

Further, each of the second heat insulation plate 60 and the first heat insulation plate 50 may be formed as an integrated piece. The integrated piece has high structural strength, and thus structural strength of the second heat insulation plate 60 and the first heat insulation plate 50 can be enhanced. As a result, it is possible to avoid a deformation of the tank body 10. In addition, manufacturing and production of the second heat insulation plate 60 and the first heat insulation plate 50 can be facilitated to improve the manufacturing efficiency of the second heat insulation plate 60 and the first heat insulation plate 50, which can further improve the manufacturing efficiency of the water tank assembly 100. In one embodiment, the number of molds developed to manufacture the tank body 10 can be reduced, which further lowers manufacturing cost of the tank body 10. Therefore, the manufacturing cost of the water tank assembly 100 can be lowered.

Figure 13:
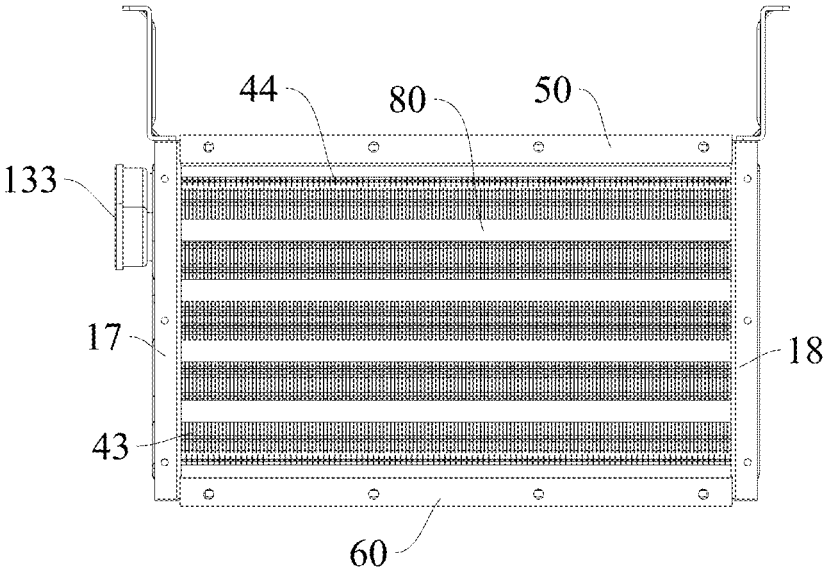
FIG. 13 is a top view of a water tank assembly of a heating device according to an embodiment of the present disclosure.
Figure 14:
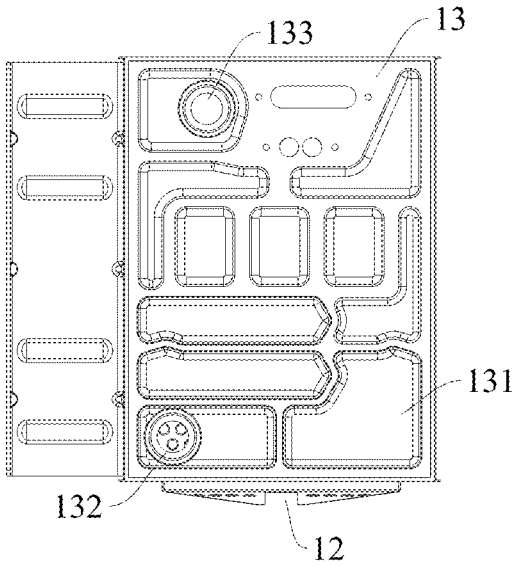
FIG. 14 is a schematic view of a first side plate assembly of a water tank assembly of a heating device according to an embodiment of the present disclosure.

In some embodiments of the present disclosure, as illustrated in FIG. 13, the tank body 10 may further include a smoke baffle 70. The smoke baffle 70 is located at a side of the condensation pipe assembly 30 away from the main heat exchange pipe assembly 20. In the up-down direction in FIG. 10, the condensation pipe assembly 30 is disposed between the smoke baffle 70 and the main heat exchange pipe assembly 20. The smoke baffle 70 is disposed below the condensation pipe assembly 30. The smoke baffle 70 may be formed as an integrated piece. That is, the smoke baffle 70 is formed as an integrated piece. The smoke baffle 70 is engaged with and connected to the second side plate 14, the first side plate 13, the second heat insulation plate 60, and the first heat insulation plate 50. The smoke outlet 12 may be formed on the smoke baffle 70. As illustrated in FIG. 5, the smoke baffle 70 is engaged with and connected to a lower end of each of the second side plate 14, the first side plate 13, the second heat insulation plate 60, and the first heat insulation plate 50. After the high temperature smoke generated through the combustion in the burner flows into the tank body 10 from the smoke inlet 11, the smoke baffle 70 can block the smoke when flowing to the smoke baffle 70, which can extend a duration for which the smoke flows out of the smoke outlet 12 to enable the smoke to stay longer in the tank body 10. In this way, a heat exchange duration of the high temperature smoke with the first heat exchange pipes 21, the second heat exchange pipes 31, and the heat exchange fin assembly 40 can be prolonged to allow the cold water to be heated through more heat, which reduces heat loss and improves the heating efficiency of the heating device 200.

In some embodiments of the present disclosure, as illustrated in FIG. 5, the smoke baffle 70 may include guide plates 71 facing away from the smoke inlet 11. The smoke outlet 12 includes a first channel 121. Ends of guide plates 71 facing away from the smoke inlet 11 are arranged at intervals to define the first channel 121. The smoke in the tank body 10 can flow out of the tank body 10 through the first channel 121. In this way, the flow area of the smoke can be ensured to allow the smoke to flow out of the tank body 10 from the smoke outlet 12 smoothly, to avoid expansion damage to the tank body 10 due to an excessive pressure in the tank body 10. As a result, explosion of the tank body 10 can be avoided, which can improve the use safety of the heating device 200.

In some embodiments of the present disclosure, as shown in FIG. 5, the smoke outlet 12 may further include a second channel 122. Second channels 122 may be formed on each guide plate 71. The second channel 122 penetrates the guide plate 71 in a thickness direction of the guide plate 71. The smoke in the tank body 10 can flow out of the tank body 10 through the second channel 122. In this way, the flow area of the smoke can be enlarged to allow the smoke in the tank body 10 to flow out of the tank body 10 through both the first channel 121 and the second channel 122. Further, it is also possible to ensure the smoke flows out of the tank body 10 from the smoke outlet 12 smoothly, to further avoid the expansion damage to the tank body 10 due to the excessive pressure in the tank body 10. As a result, the explosion of the tank body 10 can be further avoided, which can further improve the use safety of the heating device 200.

In some embodiments of the present disclosure, as shown in FIG. 7, the smoke outlet 12 may include second through holes. second through holes may each be formed into an elongated structure and arranged at intervals evenly. In this way, the flow area of the smoke can be ensured to ensure the smoke to flow out of the tank body 10 from the smoke outlet 12 smoothly, to avoid the expansion damage to the tank body 10 due to the excessive pressure in the tank body 10.

The explosion of the tank body 10 can therefore be avoided, which can improve the use safety of the heating device 200. However, the present disclosure is not limited in this regard. The smoke outlet 12 may include through holes of a round shape, an elliptic shape, a trapezoidal shape, or other shapes, as long as the shape of the through hole can function as the elongated shape.

In some embodiments of the present disclosure, first water boxes 131 is opened at a same side, and second water boxes 141 is opened at a same side. Further, each of first water boxes 131 has an open side facing towards an inside of the tank body 10, and each of second water boxes 141 has an open side facing towards the inside of the tank body 10. As illustrated in FIG. 10, first water boxes 131 is opened at a right side, and second water boxes 141 is opened at a left side. The second side plate assembly 18 may further include a second bottom plate 16. The first side plate assembly 17 may further include a first bottom plate 15. Each of the first bottom plate 15 and the second bottom plate 16 may be formed as an integrated piece. The first bottom plate 15 can be engaged with the first side plate 13 to cover the open side of each of first water boxes 131. The second bottom plate 16 can be engaged with the second side plate 14 to cover the open side of each of second water boxes 141.

Further, first bottom plates 15 may be provided and arranged in one-to-one correspondence to first water boxes 131. Second bottom plates 16 may be provided and arranged in one-to-one correspondence to second water boxes 141. A mounting hole is formed on each of first bottom plates 15 and on each of second bottom plates 16. The mounting hole of the first bottom plate 15 penetrates the first bottom plate 15, and the mounting hole of the second bottom plate 16 penetrates the second bottom plates 16. The first heat exchange pipes 21 and the second heat exchange pipes 31 each are mounted in the corresponding mounting holes. In this way, it can be ensured that water in the first water boxes 131 flows into the first heat exchange pipes 21 and the second heat exchange pipes 31. Also, it is possible to ensure that water in the second water boxes 141 flows into the first heat exchange pipes 21 and the second heat exchange pipes 31. Thus, it is possible to prevent the water from flowing out of the open sides of the first water boxes 131 and the open sides of the second water boxes 141, avoiding water leakage of the water tank assembly 100.

first bottom plates 15 may be formed into an integral plate-like structure. One first bottom plates 15 can cover the open sides of first water boxes 131 simultaneously. Second bottom plates 16 may be formed into an integral plate-like structure. One second bottom plate 16 can cover the open sides of second water boxes 141 simultaneously.

In some embodiments of the present disclosure, as illustrated in FIG. 5, at least some of first heat exchange pipes 21 each have an elliptic cross section. If flowing in the first heat exchange pipes 21 at a relatively low flow velocity with relatively high flow resistance, the water will be easily vaporized in the first heat exchange pipe 21 or scale will be formed in the first heat exchange pipe 21, which may affect the use performance and the service life of the heating device 200. Therefore, by designing each of the at least some of first heat exchange pipes 21 to have the elliptic cross section, the flow resistance of the water in the first heat exchange pipes 21 can be reduced when the water flows in the first heat exchange pipes 21, which can avoid deposition of the insoluble substances in the first heat exchange pipes 21. As a result, it is possible to avoid vaporization of the water in the first heat exchange pipes 21, and alleviate the formation of the scale in the first heat exchange pipes 21, to further improve the use performance of the heating device 200 and prolonging the service life of the heating device 200. However, the present disclosure is not limited in this regard. The first heat exchange pipe 21 may have other irregularly-shaped cross sections, as long as the cross section of the first heat exchange pipe 21 can function as the elliptic cross section.

In some embodiments of the present disclosure, first heat exchange pipes 21 is arranged in two layers in the direction from the smoke inlet 11 to the smoke outlet 12. Some of first heat exchange pipes 21 in a first layer of heat exchange pipes 22 each have an elliptic cross section, and the rest of first heat exchange pipes 21 in the first layer of heat exchange pipes each have a circular cross section. A second layer of heat exchange pipes is disposed below the first layer of heat exchange pipes. Each first heat exchange pipe 21 in the second layer of heat exchange pipes has an elliptic cross section. When the water flows in first heat exchange pipes 21, the flow resistance of the water in the first heat exchange pipes 21 can be further reduced, which can further avoid the deposition of the insoluble substances in the first heat exchange pipes 21. As a result, it is possible to further avoid the vaporization of the water in the first heat exchange pipes 21, and further alleviate the formation of the scale in the first heat exchange pipes 21, to further improve the use performance of the heating device 200 and prolonging the service life of the heating device 200.

In some embodiments of the present disclosure, a disturbance member may be disposed on the heat exchange fin assembly 40. The disturbance member is configured to divert the smoke in the tank body 10. After the high temperature smoke generated through the combustion in the burner flows into the tank body 10 from the smoke inlet 11, the smoke in the tank body 10 can be diverted by the disturbance member to prolong movement duration of the smoke in the tank body 10. Thus, sufficient heat exchange can be performed between the smoke and the heat exchange fin assembly 40, the first heat exchange pipes 21, and the second heat exchange pipes 31, which in turn can enhance the heating efficiency of the heating device 200 and improve the operation performance of the heating device 200.

In some embodiments of the present disclosure, the disturbance member may include a flange disposed on the heat exchange fin assembly 40. In this way, a structure of the disturbance member can be simplified to facilitate manufacturing and production of the disturbance member, to improve manufacturing efficiency of the disturbance member. Further, the disturbance member and the heat exchange fin assembly 40 may be integrally formed. That is, the disturbance member and the heat exchange fin assembly 40 are provided as an integrated piece. In this way, the number of parts for forming the water tank assembly 100 can be reduced. Thus, assembly efficiency of the water tank assembly 100 can be improved, to improve the manufacturing efficiency of the water tank assembly 100.

A heating device 200 according to an embodiment of the present disclosure is shown in FIG. 1 to FIG. 15. The heating device 200 may be a water heater or a wall-mounted oven. The heating device 200 includes the water tank assembly 100 as described in the above embodiments. The water tank assembly 100 is provided on the heating device 200. By communicating each reciprocating heat exchange group with one of first water boxes 131 and two of second water boxes 141 to form the series water passageway, shaping the cross section of each of first heat exchange pipes 21 into the elongated shape, and providing no disturbance member in each of the first heat exchange pipes 21, compared with the related art, in the present disclosure, the water flow rate or the water flow velocity in the main heat exchange pipe assembly 20 and the condensation pipe assembly 30 is more uniform. Further, the water vaporization and the scaling in the condensation pipe assembly 30 and the main heat exchange pipe assembly 20 can be alleviated. Also, flow resistance of the water in the first heat exchange pipes 21 can be reduced. As a result, it is possible to avoid the blockage of the first heat exchange pipes 21 and the second heat exchange pipes 31, to prevent the dry burn and the rupture from occurring to the heating device 200. Therefore, the service lives of the water tank assembly 100 the heating device 200 can be prolonged.

Other components such as a smoke valve 201 and a controller 202 and other operations of the heating device 200 according to the embodiments of the present disclosure, and thus the description thereof in detail will be omitted here.

In the description of this specification, description with reference to the terms "an embodiment", "some embodiments", "schematic embodiments", "example", "specific examples", "some examples", etc., means that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials, or characteristics may be combined in any one or more embodiments or examples in a suitable manner.

Although the embodiments of the present disclosure have been illustrated and described, it is conceivable that various changes, modifications, replacements, and variations can be made to these embodiments without departing from the present disclosure. The scope of the present disclosure shall be defined by the claims as appended and their equivalents.

What is claimed is:

1. A water tank assembly of a heating device, the water tank assembly comprising:

a tank body having a smoke inlet and a smoke outlet, the tank body comprising a first side plate assembly and a second side plate assembly that are opposite to each other, a plurality of first water boxes being defined by the first side plate assembly, a plurality of second water boxes being defined by the second side plate assembly, a water inlet and a water outlet being formed on the first side plate assembly, and each of the water inlet and the water outlet being in communication with one of the plurality of first water boxes;

a main heat exchange pipe assembly comprising a plurality of first heat exchange pipes;

a condensation pipe assembly located on a side of the main heat exchange pipe assembly facing towards the smoke outlet, the condensation pipe assembly comprising a plurality of second heat exchange pipes, the plurality of first water boxes being in communication with the plurality of second water boxes via the main heat exchange pipe assembly and the condensation pipe assembly, every two of the plurality of first heat exchange pipes being formed as a reciprocating heat exchange group, and each reciprocating heat exchange group being in communication with one of the plurality of first water boxes and with two of the plurality of second water boxes to form a series water passageway, wherein one end of a first one of the plurality of first heat exchange pipes in the reciprocating heat exchange group is in communication with one of the first water boxes, and the other end of the first one of the first heat exchange pipes is in communication with one of the two second water boxes; and one end of a second one of the plurality of first heat exchange pipes in the reciprocating heat exchange group is in communication with the other one of the two second water boxes, wherein the two second water boxes are in communication with each other; and a heat exchange fin assembly, at least some of the plurality of first heat exchange pipes and/or at least some of the plurality of second heat exchange pipes passing through the heat exchange fin assembly.

2. The water tank assembly of the heating device according to claim 1, wherein at least some of the plurality of first heat exchange pipes each have an elliptic cross section.

3. The water tank assembly of the heating device according to claim 1, further comprising a plurality of fire-side heat exchange pipes provided at a side of the main heat exchange pipe assembly facing towards the smoke inlet, the plurality of fire-side heat exchange pipes being in communication with the plurality of first water boxes and the plurality of second water boxes, respectively.

4. The water tank assembly of the heating device according to claim 3, wherein:

the plurality of fire-side heat exchange pipes is provided at an upper side of the main heat exchange pipe assembly; and no heat exchange fin is provided for the plurality of fire-side heat exchange pipes.

5. The water tank assembly of the heating device according to claim 3, wherein each of the plurality of fire-side heat exchange pipes has a circular cross section.

6. The water tank assembly of the heating device according to claim 3, wherein no disturbance member is disposed in each of the plurality of fire-side heat exchange pipes.

7. The water tank assembly of the heating device according to claim 1, wherein:

each of the plurality of first water boxes in communication with the condensation pipe assembly is in communication with at least three of the plurality of second heat exchange pipes; and the plurality of second heat exchange pipes corresponding to each of the plurality of first water boxes is arranged in rows and columns.

8. The water tank assembly of the heating device according to claim 1, wherein:

the plurality of first heat exchange pipes is arranged in one layer and passes through the heat exchange fin assembly; and the heat exchange fin assembly through which the plurality of first heat exchange pipes passes is disposed on the condensation pipe assembly.

9. The water tank assembly of the heating device according to claim 1, wherein the tank body further comprises a first heat insulation plate and a second heat insulation plate opposite to the first heat insulation plate, the first heat insulation plate being engaged with the first side plate assembly and the second side plate assembly, the second heat insulation plate being engaged with the first side plate assembly and the second side plate assembly, and each of the first heat insulation plate and the second heat insulation plate being an integrated piece.

10. The water tank assembly of the heating device according to claim 9, wherein:

the heat exchange fin assembly comprises a plurality of first fins arranged sequentially in a length direction of each of the plurality of first heat exchange pipes;

each first fin has a through hole, the through hole penetrating the first fin in a thickness direction of the first fin; and the first fin comprises a second sub-fin disposed on an inner wall of the first heat insulation plate on a side wall of the tank body.

11. The water tank assembly of the heating device according to claim 1, wherein the tank body further comprises a smoke baffle located at a side of the condensation pipe assembly away from the main heat exchange pipe assembly, the smoke outlet being formed on the smoke baffle.

12. The water tank assembly of the heating device according to claim 11, wherein:

the smoke baffle comprises a plurality of guide plates away from the smoke inlet;

the smoke outlet has a first channel; and ends of the plurality of guide plates away from the smoke inlet are arranged at intervals to define the first channel.

13. The water tank assembly of the heating device according to claim 12, wherein the smoke outlet further has a second channel, a plurality of second channels being formed on each of the plurality of guide plates.

14. A heating device, comprising:

a water tank assembly of the heating device, the water tank assembly comprising:

a tank body having a smoke inlet and a smoke outlet, the tank body comprising a first side plate assembly and a second side plate assembly that are opposite to each other, a plurality of first water boxes being defined by the first side plate assembly, a plurality of second water boxes being defined by the second side plate assembly, a water inlet and a water outlet being formed on the first side plate assembly, and each of the water inlet and the water outlet being in communication with one of the plurality of first water boxes;

a main heat exchange pipe assembly comprising a plurality of first heat exchange pipes;

a condensation pipe assembly located on a side of the main heat exchange pipe assembly facing towards the smoke outlet, the condensation pipe assembly comprising a plurality of second heat exchange pipes, the plurality of first water boxes being in communication with the plurality of second water boxes via the main heat exchange pipe assembly and the condensation pipe assembly, every two of the plurality of first heat exchange pipes being formed as a reciprocating heat exchange group, and each reciprocating heat exchange group being in communication with one of the plurality of first water boxes and with two of the plurality of second water boxes to form a series water passageway, wherein one end of a first one of the plurality of first heat exchange pipes in the reciprocating heat exchange group is in communication with one of the first water boxes, and the other end of the first one of the first heat exchange pipes is in communication with one of the two second water boxes; and one end of a second one of the plurality of first heat exchange pipes in the reciprocating heat exchange group is in communication with the other one of the two second water boxes, wherein the two second water boxes are in communication with each other; and a heat exchange fin assembly, at least some of the plurality of first heat exchange pipes and/or at least some of the plurality of second heat exchange pipes passing through the heat exchange fin assembly.

15. The heating device according to claim 14, wherein at least some of the plurality of first heat exchange pipes each have an elliptic cross section.

16. The water tank assembly of the heating device according to claim 14, further comprising a plurality of fire-side heat exchange pipes provided at a side of the main heat exchange pipe assembly facing towards the smoke inlet, the plurality of fire-side heat exchange pipes being in communication with the plurality of first water boxes and the plurality of second water boxes, respectively.

17. The heating device according to claim 16, wherein:

the plurality of fire-side heat exchange pipes is provided at an upper side of the main heat exchange pipe assembly; and no heat exchange fin is provided for the plurality of fire-side heat exchange pipes.

18. The heating device according to claim 16, wherein each of the plurality of fire-side heat exchange pipes has a circular cross section.

19. The heating device according to claim 16, wherein no disturbance member is disposed in each of the plurality of fire-side heat exchange pipes.

20. The heating device according to claim 14, wherein:

each of the plurality of first water boxes in communication with the condensation pipe assembly is in communication with at least three of the plurality of second heat exchange pipes; and the plurality of second heat exchange pipes corresponding to each of the plurality of first water boxes is arranged in rows and columns.

* * * * *